US012448188B2

(12) United States Patent
Bressan et al.

(10) Patent No.: US 12,448,188 B2
(45) Date of Patent: Oct. 21, 2025

(54) CHILD-PROOF CONTAINER

(71) Applicant: I.G.B. S.r.l., Milan (IT)

(72) Inventors: Alessio Bressan, Varese (IT); Michel Bressan, Induno Olona (IT); Alberto Gandolla, Induno Olona (IT)

(73) Assignee: I.G.B. S.r.l., Milan (IT)

( * ) Notice: Subject to any disclaimer, the term of this patent is extended or adjusted under 35 U.S.C. 154(b) by 167 days.

(21) Appl. No.: 18/353,799

(22) Filed: Jul. 17, 2023

(65) Prior Publication Data

US 2024/0025607 A1 Jan. 25, 2024

(30) Foreign Application Priority Data

Jul. 22, 2022 (IT) ..... 102022000015510

(51) Int. Cl.
*B65D 55/02* (2006.01)
*B65D 5/20* (2006.01)
(Continued)

(52) U.S. Cl.
CPC ..... *B65D 55/02* (2013.01); *B65D 5/20* (2013.01); *B65D 5/685* (2013.01); *B65D 2215/02* (2013.01)

(58) Field of Classification Search
CPC ..... B65D 1/00; B65D 1/02; B65D 1/0207; B65D 1/0215; B65D 1/0223; B65D 1/023; B65D 1/0238; B65D 1/0246; B65D 1/0261; B65D 1/0276; B65D 1/04; B65D 1/06; B65D 1/08; B65D 1/09; B65D 1/095; B65D 1/10; B65D 1/12; B65D 1/165; B65D 1/18; B65D 1/20; B65D 1/22; B65D 1/24; B65D 1/265; B65D 1/30; B65D 1/32; B65D 1/323; B65D 1/34; B65D 1/36; B65D 1/40; B65D 1/42; B65D 11/00; B65D 11/02; B65D 11/04; B65D 11/06; B65D 11/08;
(Continued)

(56) References Cited

U.S. PATENT DOCUMENTS 1,253,489 A 1/1918 Houghland
2,559,320 A 7/1951 Rushing et al.
(Continued)

FOREIGN PATENT DOCUMENTS

CN 204642380 U 9/2015
DE 202015007022 U1 * 10/2015 ..... B65D 81/3453
(Continued)

OTHER PUBLICATIONS

Italy Search Report for IT202200015510 completed Apr. 13, 2023, 5 pages.

*Primary Examiner* — Anthony D Stashick
*Assistant Examiner* — Marcos Javier Rodriguez Molina
(74) *Attorney, Agent, or Firm* — Nixon & Vanderhye P.C.

(57) ABSTRACT

A child-proof container including storage to be closed by a closure system. The container includes a first coupling portion carried by the closure system and a second coupling portion carried by the storage and configured to cooperate with said first coupling portion for locking the container in a closed condition. At least one of the sheet materials of the storage and the closure system includes a bonded and/or adhesively bonded overlap zone at which a plurality of notches are defined to define breaking portions of the overlap zone.

20 Claims, 12 Drawing Sheets

(51) Int. Cl.
*B65D 5/68* (2006.01)
*B65D 5/54* (2006.01)
*B65D 5/66* (2006.01)

(58) Field of Classification Search
CPC ..... B65D 11/10; B65D 11/12; B65D 11/16; B65D 11/1833; B65D 11/1846; B65D 11/1866; B65D 11/188; B65D 11/1893; B65D 11/20; B65D 11/22; B65D 13/00; B65D 13/04; B65D 15/00; B65D 15/06; B65D 15/08; B65D 15/18; B65D 15/22; B65D 17/00; B65D 17/02; B65D 17/04; B65D 17/06; B65D 17/08; B65D 17/14; B65D 17/28; B65D 17/32; B65D 17/34; B65D 17/347; B65D 17/353; B65D 17/36; B65D 17/38; B65D 17/401; B65D 17/4011; B65D 17/4012; B65D 17/4014; B65D 17/402; B65D 17/404; B65D 17/46; B65D 17/462; B65D 17/464; B65D 17/50; B65D 17/501; B65D 17/502; B65D 17/505; B65D 17/506; B65D 17/507; B65D 17/521; B65D 19/004; B65D 19/12; B65D 19/18; B65D 19/20; B65D 19/38; B65D 21/00; B65D 21/02; B65D 21/0201; B65D 21/0202; B65D 21/0204; B65D 21/0205; B65D 21/0206; B65D 21/0209; B65D 21/0212; B65D 21/0213; B65D 21/0215; B65D 21/0217; B65D 21/0219; B65D 21/022; B65D 21/0222; B65D 21/0223; B65D 21/0227; B65D 21/0228; B65D 21/0231; B65D 21/0233; B65D 21/04; B65D 21/08; B65D 21/083; B65D 21/086; B65D 2201/00; B65D 2203/00; B65D 2203/02; B65D 2203/06; B65D 2203/10; B65D 2203/12; B65D 2205/00; B65D 2205/02; B65D 2207/00; B65D 2209/00; B65D 2211/00; B65D 2213/00; B65D 2215/00; B65D 2215/02; B65D 2215/04; B65D 2217/04; B65D 2221/00; B65D 2231/001; B65D 2231/004; B65D 2231/005; B65D 2231/02; B65D 2231/022; B65D 2231/025; B65D 2251/00; B65D 2251/0003; B65D 2251/0006; B65D 2251/0009; B65D 2251/0012; B65D 2251/0015; B65D 2251/0018; B65D 2251/0021; B65D 2251/0025; B65D 2251/0028; B65D 2251/0031; B65D 2251/0046; B65D 2251/0053; B65D 2251/0056; B65D 2251/0059; B65D 2251/0062; B65D 2251/0068; B65D 2251/0071; B65D 2251/0075; B65D 2251/0078; B65D 2251/0081; B65D 2251/0084; B65D 2251/0087; B65D 2251/009; B65D 2251/0093; B65D 2251/0096; B65D 2251/01; B65D 2251/02; B65D 2251/023; B65D 2251/026; B65D 2251/04; B65D 2251/06; B65D 2251/065; B65D 2251/09; B65D 2251/10; B65D 2251/1008; B65D 2251/1016; B65D 2251/1025; B65D 2251/1033; B65D 2251/1041; B65D 2251/105; B65D 2251/1058; B65D 2251/1066; B65D 2251/1091; B65D 2251/20; B65D 2251/205; B65D 2255/00; B65D 2255/20; B65D 23/00; B65D 23/001; B65D 23/003; B65D 23/005; B65D 23/02; B65D 23/06; B65D 23/08; B65D 23/085; B65D 23/0878; B65D 23/0885; B65D 23/10; B65D 23/102; B65D 23/104; B65D 23/106; B65D 23/12; B65D 23/14; B65D 2301/10; B65D 2301/20; B65D 2313/00; B65D 2313/02; B65D 2313/04; B65D 2313/06; B65D 2313/08; B65D 2313/10; B65D 2401/00; B65D 2401/05; B65D 2401/10; B65D 2401/15; B65D 2401/20; B65D 2401/25; B65D 2401/30; B65D 2401/35; B65D 2401/40; B65D 2401/50; B65D 2401/55; B65D 2401/60; B65D 25/00; B65D 25/005; B65D 25/02; B65D 25/04; B65D 25/06; B65D 25/08; B65D 25/085; B65D 25/10; B65D 25/101; B65D 25/102; B65D 25/103; B65D 25/108; B65D 25/14; B65D 25/16; B65D 25/18; B65D 25/20; B65D 25/205; B65D 25/22; B65D 25/24; B65D 25/28; B65D 25/2811; B65D 25/2835; B65D 25/2858; B65D 25/2873; B65D 25/2882; B65D 25/2885; B65D 25/30; B65D 25/32; B65D 25/325; B65D 25/34; B65D 25/36; B65D 25/38; B65D 25/40; B65D 25/42; B65D 25/44; B65D 25/465; B65D 25/48; B65D 25/52; B65D 25/54; B65D 25/56; B65D 2501/0018; B65D 2501/0036; B65D 2501/0054; B65D 2501/0072; B65D 2501/0081; B65D 2501/24891; B65D 2517/0002; B65D 2517/0007; B65D 2517/0008; B65D 2517/0011; B65D 2517/0013; B65D 2517/0014; B65D 2517/0016; B65D 2517/002; B65D 2517/0022; B65D 2517/0023; B65D 2517/0025; B65D 2517/0026; B65D 2517/0028; B65D 2517/0029; B65D 2517/0031; B65D 2517/0032; B65D 2517/0038; B65D 2517/0041; B65D 2517/0043; B65D 2517/0044; B65D 2517/0046; B65D 2517/0049; B65D 2517/005; B65D 2517/0052; B65D 2517/0053; B65D 2517/0056; B65D 2517/0061; B65D 2517/0062; B65D 2517/0064; B65D 2517/0065; B65D 2517/0068; B65D 2517/007; B65D 2517/0071; B65D 2517/0073; B65D 2517/0074; B65D 2517/0076; B65D 2517/0077; B65D 2517/0079; B65D 2517/0082; B65D 2517/0083; B65D 2517/0085; B65D 2517/0086; B65D 2517/0088; B65D 2517/0089; B65D 2517/0092; B65D 2517/0094; B65D 2517/0097; B65D 2517/0098; B65D 2517/5005; B65D 2517/5013; B65D 2517/5027; B65D 2517/5029; B65D 2517/5032; B65D 2517/5037; B65D 2517/5048; B65D 2517/5054; B65D 2517/5056; B65D 2517/5059; B65D 2517/5062; B65D 2517/5064; B65D 2517/5078; B65D 2517/5081; B65D 2517/5083; B65D 2517/5086; B65D 2517/5091; B65D 2519/00019; B65D 2519/00024; B65D 2519/00034; B65D
2519/00059; B65D 2519/00064; B65D
2519/00069; B65D 2519/00099; B65D
2519/00129; B65D 2519/00139; B65D
2519/00159; B65D 2519/00164; B65D
2519/00194; B65D 2519/00199; B65D
2519/00268; B65D 2519/00273; B65D
2519/00288; B65D 2519/00293; B65D
2519/00298; B65D 2519/00323; B65D
2519/00333; B65D 2519/00338; B65D
2519/00452; B65D 2519/00497; B65D
2519/00502; B65D 2519/00532; B65D
2519/00562; B65D 2519/00597; B65D
2519/00611; B65D 2519/00621; B65D
2519/00661; B65D 2519/00666; B65D
2519/00711; B65D 2519/00726; B65D
2519/00731; B65D 2519/00815; B65D
2519/00915; B65D 2525/281; B65D
2525/282; B65D 2525/283; B65D
2525/284; B65D 2539/001; B65D
2539/003; B65D 2539/005; B65D
2543/00027; B65D 2543/00037; B65D
2543/00046; B65D 2543/00064; B65D
2543/00074; B65D 2543/00083; B65D
2543/00092; B65D 2543/00101; B65D
2543/00111; B65D 2543/0012; B65D
2543/00148; B65D 2543/00166; B65D
2543/00175; B65D 2543/00194; B65D
2543/00203; B65D 2543/00212; B65D
2543/00222; B65D 2543/00231; B65D
2543/0024; B65D 2543/0025; B65D
2543/00268; B65D 2543/00277; B65D
2543/00296; B65D 2543/00314; B65D
2543/00324; B65D 2543/00351; B65D
2543/00361; B65D 2543/0037; B65D
2543/00379; B65D 2543/00398; B65D
2543/00407; B65D 2543/00416; B65D
2543/00435; B65D 2543/00453; B65D
2543/00462; B65D 2543/00472; B65D
2543/00481; B65D 2543/0049; B65D
2543/005; B65D 2543/00509; B65D
2543/00518; B65D 2543/00527; B65D
2543/00537; B65D 2543/00546; B65D
2543/00555; B65D 2543/00564; B65D
2543/00574; B65D 2543/00583; B65D
2543/00601; B65D 2543/0062; B65D
2543/00629; B65D 2543/00648; B65D
2543/00657; B65D 2543/00666; B65D
2543/00685; B65D 2543/00694; B65D
2543/00703; B65D 2543/00731; B65D
2543/0074; B65D 2543/0075; B65D
2543/00759; B65D 2543/00768; B65D
2543/00777; B65D 2543/00796; B65D
2543/00805; B65D 2543/00814; B65D
2543/00833; B65D 2543/00842; B65D
2543/00851; B65D 2543/0087; B65D
2543/00879; B65D 2543/00888; B65D
2543/00898; B65D 2543/00907; B65D
2543/00925; B65D 2543/00935; B65D
2543/00944; B65D 2543/00953; B65D
2543/00972; B65D 2543/00981; B65D
2543/0099; B65D 2547/04; B65D
2547/06; B65D 2547/063; B65D
2547/066; B65D 2555/025; B65D
2563/107; B65D 2565/381; B65D
2565/382; B65D 2565/385; B65D
2565/386; B65D 2568/387; B65D
2571/00043; B65D 2571/00141; B65D
2571/00185; B65D 2571/00265; B65D
2571/00277; B65D 2571/00283; B65D
2571/0029; B65D 2571/00308; B65D
2571/00314; B65D 2571/0032; B65D
2571/00327; B65D 2571/00339; B65D
2571/0037; B65D 2571/00401; B65D
2571/00407; B65D 2571/00419; B65D
2571/00438; B65D 2571/00444; B65D
2571/0045; B65D 2571/00456; B65D
2571/00462; B65D 2571/00469; B65D
2571/00475; B65D 2571/00487; B65D
2571/00493; B65D 2571/00512; B65D
2571/00524; B65D 2571/0053; B65D
2571/00543; B65D 2571/00549; B65D
2571/00561; B65D 2571/00567; B65D
2571/00574; B65D 2571/0058; B65D
2571/00586; B65D 2571/00592; B65D
2571/0066; B65D 2571/00666; B65D
2571/00672; B65D 2571/00716; B65D
2571/00722; B65D 2571/00728; B65D
2571/00753; B65D 2571/00759; B65D
2571/0079; B65D 2571/00796; B65D
2571/00808; B65D 2571/00814; B65D
2571/0082; B65D 2571/00833; B65D
2571/00839; B65D 2571/00845; B65D
2571/00851; B65D 2571/00864; B65D
2571/0087; B65D 2571/00876; B65D
2571/00882; B65D 2571/00895; B65D
2571/00925; B65D 2571/00993; B65D
2575/32; B65D 2575/3218; B65D
2575/3227; B65D 2575/3236; B65D
2575/3245; B65D 2575/3263; B65D
2575/3272; B65D 2575/3281; B65D
2575/329; B65D 2575/362; B65D
2575/363; B65D 2575/365; B65D
2575/366; B65D 2575/367; B65D
2575/368; B65D 2575/565; B65D
2575/58; B65D 2575/583; B65D
2575/586; B65D 2577/042; B65D
2577/043; B65D 2575/045; B65D
2577/2025; B65D 2577/2033; B65D
2577/2066; B65D 2577/205; B65D
2577/2058; B65D 2577/2083; B65D
2577/2091; B65D 2581/3405; B65D
2581/3406; B65D 2581/3421; B65D
2581/3425; B65D 2581/344; B65D
2581/3444; B65D 2581/3455; B65D
2564/3464; B65D 2581/3466; B65D
2581/3472; B65D 2581/3477; B65D
2581/3479; B65D 2581/3489; B65D
2581/3494; B65D 2581/3495; B65D
2581/3497; B65D 2581/3498; B65D
2583/005; B65D 2583/04; B65D
2583/0404; B65D 2583/0409; B65D
2583/0413; B65D 2583/0418; B65D
2583/0431; B65D 2583/044; B65D
2583/0454; B65D 2583/059; B65D
2583/0463; B65D 2583/0468; B65D
2583/0472; B65D 2583/0477; B65D
2583/0481; B65D 2583/049; B65D
2583/0495; B65D 2583/363; B65D
2583/366; B65D 2585/56; B65D 2585/6867; B65D 2585/6882; B65D 2585/88; B65D 2588/165; B65D 2590/046; B65D 27/00; B65D 27/04; B65D 27/14; B65D 27/28; B65D 27/34; B65D 27/38; B65D 29/00; B65D 29/04; B65D 3/00; B65D 3/02; B65D 3/04; B65D 3/06; B65D 3/08; B65D 3/12; B65D 3/16; B65D 3/18; B65D 3/22; B65D 3/26; B65D 3/261; B65D 3/262; B65D 3/263; B65D 3/265; B65D 3/266; B65D 3/267; B65D 3/268; B65D 3/28; B65D 3/30; B65D 31/00; B65D 31/02; B65D 31/04; B65D 31/10; B65D 31/12; B65D 31/14; B65D 31/147; B65D 31/16; B65D 31/18; B65D 33/00; B65D 33/001; B65D 33/004; B65D 33/007; B65D 33/008; B65D 33/01; B65D 33/02; B65D 33/04; B65D 33/06; B65D 33/08; B65D 33/12; B65D 33/14; B65D 33/16; B65D 33/1658; B65D 33/1666; B65D 33/1675; B65D 33/1683; B65D 33/1691; B65D 33/20; B65D 33/24; B65D 33/25; B65D 33/2508; B65D 33/2516; B65D 33/2525; B65D 33/2533; B65D 33/2541; B65D 33/2566; B65D 33/2575; B65D 33/2584; B65D 33/25865; B65D 33/2588; B65D 33/2589; B65D 33/259; B65D 33/28; B65D 33/30; B65D 33/32; B65D 33/34; B65D 35/02; B65D 35/04; B65D 35/08; B65D 35/10; B65D 35/22; B65D 35/24; B65D 35/28; B65D 35/30; B65D 35/38; B65D 35/40; B65D 35/44; B65D 35/46; B65D 35/56; B65D 37/00; B65D 39/00; B65D 39/0017; B65D 39/0023; B65D 39/0035; B65D 39/0052; B65D 39/007; B65D 39/04; B65D 39/06; B65D 39/08; B65D 39/082; B65D 39/084; B65D 39/088; B65D 39/10; B65D 39/12; B65D 39/16; B65D 41/00; B65D 41/005; B65D 41/02; B65D 41/04; B65D 41/0414; B65D 41/0421; B65D 41/0428; B65D 41/0435; B65D 41/0442; B65D 41/045; B65D 41/0457; B65D 41/0471; B65D 41/0478; B65D 41/0485; B65D 41/0492; B65D 41/06; B65D 41/065; B65D 41/08; B65D 41/083; B65D 41/10; B65D 41/14; B65D 41/16; B65D 41/165; B65D 41/17; B65D 41/18; B65D 41/185; B65D 41/20; B65D 41/26; B65D 41/28; B65D 41/30; B65D 41/32; B65D 41/325; B65D 41/34; B65D 41/3404; B65D 41/3409; B65D 41/3423; B65D 41/3428; B65D 41/3433; B65D 41/3438; B65D 41/3442; B65D 41/3447; B65D 41/3452; B65D 41/3457; B65D 41/3466; B65D 41/348; B65D 41/3485; B65D 41/3495; B65D 41/36; B65D 41/365; B65D 41/40; B65D 41/42; B65D 41/44; B65D 41/46; B65D 41/47; B65D 41/48; B65D 41/485; B65D 41/50; B65D 41/565; B65D 41/58; B65D 41/60; B65D 41/62; B65D 43/00; B65D 43/02; B65D 43/0202; B65D 43/0204; B65D 43/0206; B65D 43/0208; B65D 43/021; B65D 43/0212; B65D 43/0218; B65D 43/022; B65D 43/0222; B65D 43/0225; B65D 43/0229; B65D 43/0231; B65D 43/0235; B65D 43/0237; B65D 43/0239; B65D 43/0241; B65D 43/0247; B65D 43/0249; B65D 43/0252; B65D 43/0254; B65D 43/0256; B65D 43/0258; B65D 43/026; B65D 43/0262; B65D 43/0264; B65D 43/0266; B65D 43/0268; B65D 43/0272; B65D 43/0274; B65D 43/0277; B65D 43/0283; B65D 43/0289; B65D 43/0291; B65D 43/0293; B65D 43/0295; B65D 43/06; B65D 43/12; B65D 43/14; B65D 43/16; B65D 43/161; B65D 43/162; B65D 43/163; B65D 43/164; B65D 43/165; B65D 43/166; B65D 43/169; B65D 43/18; B65D 43/20; B65D 43/22; B65D 43/26; B65D 45/00; B65D 45/04; B65D 45/16; B65D 45/20; B65D 45/28; B65D 45/30; B65D 45/32; B65D 45/325; B65D 45/327; B65D 45/34; B65D 47/00; B65D 47/02; B65D 47/043; B65D 47/046; B65D 47/06; B65D 47/061; B65D 47/063; B65D 47/065; B65D 47/066; B65D 47/068; B65D 47/08; B65D 47/0804; B65D 47/0809; B65D 47/0838; B65D 47/0842; B65D 47/0847; B65D 47/0852; B65D 47/0857; B65D 47/0866; B65D 47/0876; B65D 47/0885; B65D 47/089; B65D 47/0895; B65D 47/10; B65D 47/103; B65D 47/106; B65D 47/12; B65D 47/121; B65D 47/122; B65D 47/123; B65D 47/127; B65D 47/14; B65D 47/141; B65D 47/147; B65D 47/148; B65D 47/18; B65D 47/185; B65D 47/20; B65D 47/2006; B65D 47/2018; B65D 47/2025; B65D 47/2031; B65D 4/2037; B65D 47/205; B65D 47/2056; B65D 47/2062; B65D 47/2068; B65D 47/2075; B65D 47/2081; B65D 47/242; B65D 47/243; B65D 47/244; B65D 47/247; B65D 47/248; B65D 47/26; B65D 47/261; B65D 47/263; B65D 47/265; B65D 47/266; B65D 47/268; B65D 47/283; B65D 47/286; B65D 47/30; B65D 47/305; B65D 47/32; B65D 47/36; B65D 47/42; B65D 49/00; B65D 49/04; B65D 49/12; B65D 5/00; B65D 5/0005; B65D 5/001; B65D 5/003; B65D 5/0035; B65D 5/0055; B65D 5/008; B65D 5/02; B65D 5/0209; B65D 5/0227; B65D 5/0236; B65D 5/0245; B65D 5/0254; B65D 5/0263; B65D 5/0281; B65D 5/029; B65D 5/04; B65D 5/06; B65D 5/061; B65D 5/062; B65D 5/064; B65D 5/065; B65D 5/067; B65D 5/068; B65D 5/08; B65D 5/10; B65D 5/103; B65D 5/106; B65D 5/12; B65D 5/14; B65D 5/16; B65D 5/18; B65D 5/20; B65D 5/2009; B65D 5/2028; B65D 5/2033; B65D 5/2042; B65D 5/2047; B65D 5/2052; B65D 5/2057; B65D 5/2061; B65D 5/2076; B65D 5/22; B65D 5/244; B65D 5/243; B65D 5/28; B65D 5/302; B65D 5/32; B65D 5/321; B65D 5/322; B65D 5/324; B65D 5/326; B65D 5/328; B65D 5/36; B65D 5/3607; B65D 5/3621; B65D 5/3628; B65D 5/3664; B65D 5/3685; B65D 5/38; B65D 5/40; B65D 5/42; B65D 5/4204; B65D 5/4208; B65D 5/4212; B65D 5/4216; B65D 5/422; B65D 5/4225; B65D 5/4229; B65D 5/4233; B65D 5/4237; B65D 5/4241; B65D 5/425; B65D 5/4266; B65D 5/4279; B65D 5/4283; B65D 5/4295; B65D 5/44; B65D 5/441; B65D 5/443; B65D 5/445; B65D 5/46; B65D 5/46008; B65D 5/46016; B65D 5/46032; B65D 5/4604; B65D 5/46072; B65D 5/4608; B65D 5/46088; B65D 5/46096; B65D 5/46112; B65D 5/4612; B65D 5/46152; B65D 5/48; B65D 5/48002; B65D 5/48008; B65D 5/4801; B65D 5/48012; B65D 5/48014; B65D 43/48016; B65D 5/48018; B65D 5/48024; B65D 5/48036; B65D 5/48038; B65D 5/48048; B65D 5/50; B65D 5/5002; B65D 5/5007; B65D 5/5009; B65D 5/5011; B65D 5/5016; B65D 5/5019; B65D 5/5021; B65D 5/5023; B65D 5/5028; B65D 5/503; B65D 5/5035; B65D 5/5038; B65D 5/504; B65D 5/505; B65D 5/5059; B65D 5/5088; B65D 5/509; B65D 5/52; B65D 5/5213; B65D 5/5233; B65D 5/5253; B65D 5/526; B65D 5/5273; B65D 5/5286; B65D 5/54; B65D 5/5405; B65D 5/541; B65D 5/5415; B65D 5/542; B65D 5/5425; B65D 5/543; B65D 5/5435; B65D 5/544; B65D 5/5445; B65D 5/545; B65D 5/5455; B65D 5/546; B65D 5/5465; B65D 5/547; B65D 5/5475; B65D 5/548; B65D 5/5485; B65D 5/549; B65D 5/5495; B65D 5/56; B65D 5/563; B65D 5/566; B65D 5/60; B65D 5/603; B65D 5/606; B65D 5/62; B65D 5/64; B65D 5/643; B65D 5/646; B65D 5/66; B65D 5/6602; B65D 5/6605; B65D 5/6608; B65D 5/6611; B65D 5/6614; B65D 5/6626; B65D 5/665; B65D 5/6652; B65D 5/6655; B65D 5/6661; B65D 5/6664; B65D 5/6667; B65D 5/667; B65D 5/6673; B65D 5/6685; B65D 5/685; B65D 5/70; B65D 5/701; B65D 5/708; B65D 5/72; B65D 5/721; B65D 5/725; B65D 5/726; B65D 5/741; B65D 5/742; B65D 5/744; B65D 5/749; B65D 5/76; B65D 50/00; B65D 50/041; B65D 50/043; B65D 50/06; B65D 50/061; B65D 50/065; B65D 50/066; B65D 51/00; B65D 51/002; B65D 51/10; B65D 51/145; B65D 51/1622; B65D 51/1627; B65D 51/1644; B65D 51/1661; B65D 51/1677; B65D 51/185; B65D 51/20; B65D 51/223; B65D 51/224; B65D 51/228; B65D 51/24; B65D 51/244; B65D 51/245; B65D 51/249; B65D 51/26; B65D 51/2821; B65D 51/2828; B65D 51/285; B65D 51/2864; B65D 51/2878; B65D 51/30; B65D 51/32; B65D 53/06; B65D 53/08; B65D 55/024; B65D 55/026; B65D 55/066; B65D 55/08; B65D 55/0854; B65D 55/0863; B65D 55/089; B65D 55/14; B65D 55/145; B65D 55/16; B65D 63/1072; B65D 65/00; B65D 65/18; B65D 65/22; B65D 65/403; B65D 65/42; B65D 67/02; B65D 7/00; B65D 7/02; B65D 7/10; B65D 7/24; B65D 7/26; B65D 71/00; B65D 71/0014; B65D 71/0085; B65D 71/0096; B65D 71/063; B65D 71/08; B65D 71/125; B65D 71/16; B65D 71/20; B65D 71/22; B65D 71/28; B65D 71/30; B65D 71/32; B65D 71/34; B65D 71/36; B65D 71/38; B65D 71/403; B65D 71/42; B65D 71/44; B65D 71/46; B65D 71/48; B65D 71/50; B65D 71/502; B65D 71/504; B65D 71/506; B65D 71/70; B65D 71/72; B65D 73/00; B65D 73/0014; B65D 73/0021; B65D 73/0028; B65D 73/0035; B65D 73/0057; B65D 73/0064; B65D 73/0078; B65D 73/0085; B65D 73/0092; B65D 73/02; B65D 75/00; B65D 75/0002; B65D 75/004; B65D 75/008; B65D 75/02; B65D 75/04; B65D 75/12; B65D 75/14; B65D 75/20; B65D 75/22; B65D 75/24; B65D 75/245; B65D 75/26; B65D 75/28; B65D 75/30; B65D 75/305; B65D 75/32; B65D 75/322; B65D 75/323; B65D 75/324; B65D 75/325; B65D 75/326; B65D 75/327; B65D 75/328; B65D 75/34; B65D 75/36; B65D 75/366; B65D 75/367; B65D 75/368; B65D 75/38; B65D 75/40; B65D 75/42; B65D 75/46; B65D 75/48; B65D 75/52; B65D 75/522; B65D 75/525; B65D 75/527; B65D 75/54; B65D 75/545; B65D 77/56; B65D 75/563; B65D 75/566; B65D 75/58; B65D 75/5805; B65D 75/5811; B65D 75/5816; B65D 75/5822; B65D 75/5827; B65D 75/5833; B65D 75/5838; B65D 75/5844; B65D 75/585; B65D 75/5855; B65D 75/5861; B65D 75/5866; B65D 75/5872; B65D 75/5877; B65D 75/5883; B65D 75/5888; B65D 75/5894; B65D 75/66; B65D 75/68; B65D 77/00; B65D 77/003; B65D 77/006; B65D 77/02; B65D 77/04; B65D 77/0406; B65D 77/0413; B65D 77/042; B65D 77/0426; B65D 77/0433; B65D 77/044; B65D 77/0446; B65D 77/0453; B65D 77/046; B65D 77/0473; B65D 77/048; B65D 77/0486; B65D 77/0493; B65D 77/06; B65D 77/061; B65D 77/062; B65D 77/064; B65D 77/065; B65D 77/067; B65D 77/068; B65D 77/08; B65D 77/10; B65D 77/12; B65D 77/20; B65D 77/2016; B65D 77/2024; B65D 77/2028; B65D 77/2032; B65D 77/204; B65D 77/2044; B65D 77/2052; B65D 77/2056; B65D 77/206; B65D 77/2092; B65D 77/2096; B65D 77/22; B65D 77/225; B65D 77/24; B65D 77/245; B65D 77/26; B65D 77/28; B65D 77/283; B65D 77/286; B65D 77/30; B65D 77/32; B65D 77/36; B65D 77/38; B65D 77/40; B65D 79/00; B65D 79/0087; B65D 79/02; B65D 81/00; B65D 81/02; B65D 81/022; B65D 81/027; B65D 81/03; B65D 81/05; B65D 81/051; B65D 81/055; B65D 81/057; B65D 81/07; B65D 81/107; B65D 81/113; B65D 81/20; B65D 81/2015; B65D 81/2023; B65D 81/2038; B65D 81/2053; B65D 81/2061; B65D 81/2069; B65D 81/2076; B65D 81/2084; B65D 81/22; B65D 81/24; B65D 81/26; B65D 81/261; B65D 81/263; B65D 81/264; B65D 81/266; B65D 81/267; B65D 81/268; B65D 81/28; B65D 81/30; B65D 81/32; B65D 81/3205; B65D 81/3211; B65D 81/3216; B65D 81/3222; B65D 81/3227; B65D 81/325; B65D 81/3261; B65D 81/3266; B65D 81/3272; B65D 81/3283; B65D 81/3288; B65D 81/3294; B65D 81/34; B65D 81/343; B65D 81/3446; B65D 81/3453; B65D 81/3484; B65D 81/36; B65D 81/361; B65D 81/363; B65D 81/365; B65D 81/366; B65D 81/38; B65D 81/3816; B65D 81/382; B65D 81/3834; B65D 81/3837; B65D 81/3841; B65D 81/3846; B65D 81/386; B65D 81/3862; B65D 81/3869; B65D 81/3874; B65D 83/00; B65D 83/0005; B65D 83/0016; B65D 83/02; B65D 83/04; B65D 83/0409; B65D 83/0418; B65D 83/0427; B65D 83/0445; B65D 83/0454; B65D 83/0463; B65D 83/0472; B65D 83/0481; B65D 83/049; B65D 83/06; B65D 83/08; B65D 83/0805; B65D 83/0811; B65D 83/0817; B65D 83/0823; B65D 83/0835; B65D 83/0841; B65D 83/0847; B65D 83/0852; B65D 83/0882; B65D 83/0888; B65D 83/0894; B65D 83/12; B65D 83/141; B65D 83/145; B65D 83/164; B65D 83/20; B65D 83/206; B65D 83/22; B65D 83/222; B65D 83/226; B65D 83/228; B65D 83/24; B65D 83/262; B65D 83/267; B65D 83/28; B65D 83/285; B65D 83/30; B65D 83/303; B65D 83/32; B65D 83/38; B65D 83/384; B65D 83/386; B65D 83/40; B65D 83/42; B65D 83/44; B65D 83/46; B65D 83/52; B65D 83/56; B65D 83/682; B65D 83/753; B65D 83/7535; B65D 83/754; B65D 83/757; B65D 83/76; B65D 83/761; B65D 83/762; B65D 83/765; B65D 83/771; B65D 83/7711; B65D 83/7713; B65D 85/00; B65D 85/07; B65D 85/08; B65D 85/10; B65D 85/1009; B65D 85/1018; B65D 85/1027; B65D 85/1036; B65D 85/1045; B65D 85/1054; B65D 85/1056; B65D 85/10564; B65D 85/10568; B65D 85/1081; B65D 85/109; B65D 85/12; B65D 85/18; B65D 85/182; B65D 85/185; B65D 85/187; B65D 85/20; B65D 85/24; B65D 85/26; B65D 85/30; B65D 85/324; B65D 85/34; B65D 85/36; B65D 85/38; B65D 85/48; B65D 85/50; B65D 85/505; B65D 85/52; B65D 85/54; B65D 85/542; B65D 85/546; B65D 85/58; B65D 85/60; B65D 85/62; B65D 85/66; B65D 85/671; B65D 85/672; B65D 85/68; B65D 85/70; B65D 85/72; B65D 85/74; B65D 85/78; B65D 85/80; B65D 85/8043; B65D 85/8046; B65D 85/8049; B65D 85/8052; B65D 85/8055; B65D 85/8058; B65D 85/8061; B65D 85/8067; B65D 85/808; B65D 85/8085; B65D 85/812; B65D 85/816; B65D 88/12; B65D 88/128; B65D 88/1618; B65D 88/1675; B65D 88/1687; B65D 88/748; B65D 9/08; B65D 9/12; B65D 9/34; B65D 90/0013; B65D 90/028; B65D 90/047; B65D 90/048

USPC .... 70/289; 206/0.5, 1.5, 104, 106, 108, 109, 206/110, 115, 204, 205, 213.1, 216, 217, 206/219, 221, 222, 223, 227, 229, 232, 206/245, 262, 264, 273, 303, 308.1, 309, 206/315.11, 317, 319, 363, 364, 365, 370, 206/373, 38, 380, 390, 395, 397, 416, 206/425, 438, 439, 440, 45.2, 456, 457, 206/459.1, 459.5, 461, 462, 464, 467, 206/468, 469, 470, 471, 472, 473, 474, 206/475, 484, 484.1, 484.2, 486, 494, 206/495, 496, 497, 499, 501, 508, 509, 206/514, 518, 519, 520, 524.1, 524.2, 206/524.6, 524.7, 525, 526, 528, 529, 206/530, 531, 532, 533, 534, 534.1, 206/534.2, 535, 536, 538, 539, 540, 554, 206/557, 561, 562, 570, 572, 581, 591, 206/756, 784, 804, 807, 809, 813, 820, 206/822, 824, 828, 98

See application file for complete search history.

(56) References Cited

U.S. PATENT DOCUMENTS

| | | | | |
|---|---|---|---|---|
| 5,671,883 | A | 9/1997 | Philips | |
| 11,365,022 | B2 * | 6/2022 | Altman | B65D 43/20 |
| 2005/0173269 | A1 * | 8/2005 | Lebras | B65D 71/0022 206/427 |
| 2005/0173291 | A1 | 8/2005 | Specker et al. | |
| 2012/0234701 | A1 | 9/2012 | Albrecht et al. | |
| 2014/0262839 | A1 | 9/2014 | Le et al. | |
| 2017/0036808 | A1 * | 2/2017 | Everett | B65D 5/38 |
| 2022/0161962 | A1 * | 5/2022 | Thompson | B65D 5/46008 |
| 2022/0204210 | A1 * | 6/2022 | Joines | B65D 5/38 |

FOREIGN PATENT DOCUMENTS

| | | | | |
|---|---|---|---|---|
| EP | 1136372 | A1 * | 9/2001 | B65D 5/548 |
| EP | 2716571 | A1 * | 4/2014 | B65D 81/368 |
| EP | 2808265 | A1 | 12/2014 | |
| EP | 2810885 | A1 | 12/2014 | |
| EP | 3907149 | B1 * | 10/2022 | B65D 85/70 |
| GB | 2392664 | A * | 3/2004 | B65D 5/545 |
| GB | 2418419 | A * | 3/2006 | B65D 5/0281 |
| WO | WO-2005049437 | A1 * | 6/2005 | B65D 5/38 |
| WO | 2005068304 | A2 | 7/2005 | |
| WO | 2009038219 | A1 | 3/2009 | |
| WO | 2012112538 | A1 | 8/2012 | |
| WO | 2021044268 | A1 | 3/2021 | |
| WO | WO-2021044266 | A1 * | 3/2021 | B65D 5/665 |
| WO | WO-2021044267 | A1 * | 3/2021 | B65D 50/045 |
| WO | WO-2021075981 | A1 * | 4/2021 | B65D 85/50 |
| WO | WO-2022108541 | A1 * | 5/2022 | B65D 5/667 |

* cited by examiner

CHILD-PROOF CONTAINER

RELATED APPLICATION

This application incorporates by reference and claims priority to Italian patent application 102022000015510, filed Jul. 22, 2022.

TECHNICAL FIELD

The present invention relates to a child-proof container and a process for making the same. The container can be used for packaging products of various kinds, such as drugs, cosmetics, cleaning products (laundry and dishwashing detergents), food and tobacco products (cigars and cigarettes).

BACKGROUND

Child-resistant packages, designed to be difficult for children under the age of 5 to open, are known in the art to prevent them from coming into contact with potentially harmful products.

A first type of child-resistant package is described in the following patent applications: US 2005/0173291 A1; EP 2 808 265 A1; WO 2005/068304 A2; US 2014/262839 A1; EP 2 810 885 A1; US 2012/234701 A1; CN 204 642 380 U; WO 2012/112538 A1; WO 2009/038219 A1; U.S. Pat. No. 1,253,489 A. These packages have a locking system that allows them to be maintained in a closed condition; the packages can be opened from the outside by action on the locking system that can be reached by the presence of a through-access defined on a side wall of the package. However, it is noted how the structure of such packages is complex and at the same time how the locking system can be easily bypassed: such packages are unable to provide an adequate degree of security to prevent children under the age of 5 from opening the package.

A second type of child-resistant package is described in Patent Application No. WO 2021/044266 A1 of the Applicant. The package includes a container for housing products, which is reclosable by means of an outer case; the container and the case include respective coupling portions configured for engaging with each other and allowing the package to be locked in the closed condition. The case includes a through-access defined on a side wall and suitable for allowing the user to intervene on the coupling portion of the container for allowing it to disengage to the coupling portion of the case, thereby allowing the package to be opened. Although the package described in Patent Application No. WO 2021/044266 A1 has a child-resistant system that is more effective in terms of safety and can be quickly released by an adult, the Applicant noted that this package could also be improved.

SUMMARY

The present invention may be embodied to provide an effective and extremely safe child-proof container that can prevent the opening by children, but at the same time can be easily opened by an adult. It is then the purpose of the present invention to provide a container that is flexible in its use, having a compact and extremely resistant structure.

The invention may be embodied as a child-proof container (1) is provided, including:

a storage (2) made of sheet material defining a compartment (3) and having at least one side wall defining a passage opening delimited by a free edge (6), said passage opening being configured for placing the compartment (3) in communication with the external environment, a closure system (7) made of sheet material engageable to storage (2) for obstructing the passage opening, wherein the closure system (7) and the storage (2) are movable with respect to each other at least between:

a closed condition where the closure system (7) prevents communication between the compartment (3) of storage (2) and the external environment, an open condition in which the closure system (7) allows communication between the compartment (3) of storage (2) and the external environment, at least a first coupling portion (12) carried by the closure system (7), at least a second coupling portion (13) carried by storage (2) and configured for cooperating with said first coupling portion (12), wherein the first and second coupling portions (12, 13) are configured to engage with each other in the closed condition to define a locking condition of the container (1) wherein said first and second coupling portions (12, 13) prevent the closure system (7) and the storage (2) from switching from the closed to the open condition.

In an aspect according to the preceding aspect, at least one of the storage (2) and the closure system (7) includes a release portion (60) configured for allowing, at least in the locking condition, the disengagement between the first and second coupling portions (12, 13) and allowing the storage (2) and the closure system (7) to switch from the closed to the open condition.

In an aspect according to any one of the preceding aspects at least one of the sheet material of the storage (2) and the sheet material of the closure system (7) comprises at least a first constraining portion (31) and a second constraining portion (32) overlapping each other to define an overlap zone which has a peripheral zone (30*a*) surrounding a central zone (30*b*), wherein the first and second constraining portions (31, 32) are engaged with each other for at least a portion of the peripheral zone (30*a*), wherein the second constraining portion (32) delimits at least a portion of an outer surface of the container (1), and, for at least a portion of the peripheral zone (30*a*), has at least a plurality of notches (33) suitable for defining at least one breaking portion, separable from the second constraining portion (32). In an aspect according to the preceding aspect the at least one breaking portion defined by the plurality of notches (33) is separable from the central zone (30*b*) of the overlap zone.

In an aspect according to the preceding aspect, the plurality of notches (33) defines a plurality of breaking portions arranged at least along a section of the peripheral zone (30*a*) of the overlap zone.

In an aspect according to any one of the preceding aspects, the second constraining portion (32) is delimited by a perimeter edge (32*a*), wherein at least part of the plurality of notches (33) extends for at least one section from the perimeter edge (32*a*) towards the central zone (30*b*). In an aspect according to the preceding aspect, all the notches (33) extend from the perimeter edge (32) of the second constraining portion (32). In an aspect according to any one of the preceding aspects at least a part of the notches of the plurality of notches is joined in one piece to the perimeter edge (32*a*) of the second constraining portion (32).

In an aspect according to any one of the preceding aspects each notch (33) of said plurality is exclusively defined within the peripheral zone (30*a*) of the overlap zone of the closure system (7). In an aspect according to any one of the preceding aspects the central zone (30*b*) of the overlap zone of the closure system (7) is devoid of notches. In an aspect according to any one of the preceding aspects the notches of said plurality of notches (33) are aligned at least along a single trajectory, optionally curved, or along different broken lines.

In an aspect according to any one of the preceding aspects at least part of the notches, optionally all the notches, of said plurality of notches (33) has a shape having concavity facing the perimeter edge (32*a*) of the second constraining portion (32). In an aspect according to any one of the preceding aspects at least part of the notches, optionally all the notches, of said plurality of notches (33), has a substantially "U" or "C" or "L" shape.

In an aspect according to any one of the preceding aspects the notches of said plurality of notches are in number between 3 and 50, optionally between 5 and 30. In an aspect according to any one of the preceding aspects the ratio between a surface footprint area of the peripheral zone (30*a*) of the overlap zone and a surface footprint area of the central zone (30*b*) of the overlap zone is equal to or comprised between 0.1 and 0.5, optionally equal to or comprised between 0.1 and 0.25.

In an aspect according to any one of the preceding aspects the perimeter edge (32*a*) has a predetermined extension, the plurality of notches (33) extends for a preponderant part of the extension of the perimeter edge (32*a*). In an aspect according to the preceding aspect, the plurality of notches extends for at least 50%, optionally at least 70%, of the extension of the perimeter edge (32*a*) of the second constraining portion (32). In an aspect according to any one of the preceding aspects, the plurality of notches is defined on a preponderant part of the peripheral zone (30*a*) of the overlap zone. In an aspect according to any one of the preceding aspects the plurality of notches is defined over at least 50%, optionally at least 70%, of the extension of the peripheral zone (30*a*) of the overlap zone.

In an aspect according to any one of the preceding aspects the plurality of notches (33) comprises at least one series of notches (330) comprising a plurality of notches aligned at least along a trajectory (T1). In an aspect according to any one of the preceding aspects, the plurality of notches of the series of notches (330) defines, on the second constraining portion (32), a plurality of breaking portions arranged at least along a section of the peripheral zone (30*a*) of the overlap zone. In an aspect according to any one of the preceding aspects at least part of the plurality of notches of the series of notches (330) extends for at least a section, from the perimeter edge (32*a*) towards the central zone (30*b*). In an aspect according to the preceding aspect, all the notches of the series of notches (330) extends from the perimeter edge (32*a*) of the second constraining portion (32). In an aspect according to any one of the preceding aspects at least a part of the notches of the series of notches (330) is joined in one piece to the perimeter edge (32*a*) of the second constraining portion (32).

In one aspect according to any one of the preceding aspects each notch of the series of notches (330) extends within the peripheral zone (30*a*) of the overlap zone.

In an aspect according to any one of the preceding aspects at least part of the notches, optionally all the notches, of the series of notches (330) has a shape having concavity facing the perimeter edge (32*a*) of the second constraining portion (32). In an aspect according to any one of the preceding aspects at least part of the notches, optionally all the notches, of the series of notches (330), has a substantially "U" or "C" or "L" shape. In an aspect according to any one of the preceding aspects, the trajectory (T1) along which the notches of the series of notches (330) are aligned, exhibits a curvilinear conformation whose concavity faces the central zone (30*b*) of the overlap zone. In an aspect according to any one of the preceding aspects, the trajectory (T1) along which the notches of the series of notches (330) are aligned has a "U", "C", "L" or "V" shape.

In an aspect according to any one of the preceding aspects the notches of the series of notches (330) are discrete elements, spaced apart from each other. In an aspect according to any one of the preceding aspects the notches of the series of notches (330) are evenly distributed within the peripheral zone (30*a*) of the overlap zone. In an aspect according to any one of the preceding aspects the notches of the series of notches (330) are in number comprised between 3 and 50, optionally comprised between 5 and 30.

In an aspect according to any one of the preceding aspects the notches of the series of notches (330) extend for a preponderant part of the extension of the perimeter edge (32*a*). In an aspect according to the preceding aspect the notches of the series of notches (330) extend for at least 50%, optionally at least 70%, of the extension of the perimeter edge (32*a*) of the second constraining portion (32). In an aspect according to any one of the preceding aspects, the notches of the series of notches (330) are defined over a preponderant part of the peripheral zone (30*a*) of the second constraining portion (32). In an aspect according to any one of the preceding aspects the notches of the series of notches (330) are defined on at least 50%, optionally at least 70%, of the extension of the peripheral zone (30*a*) of the second constraining portion (32).

In an aspect according to any one of the preceding aspects the plurality of notches consists solely of said series of notches (330).

In an aspect according to any one of the preceding aspects the at least one series of notches (330) includes a first and second series of notches (330', 330"). In one aspect according to the preceding aspect the first and second series of notches (330', 330") extend along respective trajectories. In an aspect according to any one of the preceding aspects the first and second series of notches (330', 330") are defined in the peripheral zone (30*a*) of the overlap zone. In an aspect according to any one of the preceding aspects the first and second series of notches (330', 330") are spaced apart proceeding from the perimeter edge (32*a*) toward the central zone (30*b*) of the overlap zone. In one aspect according to any one of the preceding aspects the respective extension trajectories of the first and second series of notches (330', 330") are, at least for a section, parallel to each other.

In an aspect according to any one of the preceding aspects the second series of notches (330") extends to the side of the first series of notches (330') for at least part, optionally all, an extension of the first series of notches (330') along the peripheral zone (30*a*).

In an aspect according to any one of the preceding aspects the respective extension trajectories of the first and second series of notches (330', 330") are concentric to each other proceeding from the perimeter edge (32*a*) toward the central zone of the overlap zone. In one aspect according to any one of the preceding aspects the notches of the first series of notches (330') have a different conformation than the notches of the second series of notches (330").

In an aspect according to any one of the preceding aspects, the first series of notches (330') is interposed between the perimeter edge (32*a*) of the second constraining portion (32) and the central zone (30*b*) of the overlap zone.

In an aspect according to any one of the preceding aspects, the plurality of notches (33) includes at least one auxiliary notch (340) arranged to the side of the series of notches (330), in interposition between said series of notches (330) and the central zone (30*b*) of the overlap zone.

In an aspect according to any one of the preceding aspects the at least one auxiliary notch (340) extends to the side of the series of notches (330) for at least part, optionally all, an extension of said series of notches (330) along the peripheral zone (30*a*). In an aspect according to any one of the preceding aspects the at least one auxiliary notch (340) is at least partially countershaped to the perimeter edge (32*a*) of the second constraining portion (32).

In an aspect according to any one of the preceding aspects the series of notches (330) and the at least one auxiliary notch (340) are placed concentrically to each other.

In an aspect according to any one of the preceding aspects the at least one auxiliary notch (340) extends for a preponderant part of the extension of the perimeter edge (32*a*). In an aspect according to any one of the preceding aspects the at least one auxiliary notch (340) extends for at least 50%, optionally for at least 70%, of the extension of the perimeter edge (32*a*) of the second constraining portion (32). In an aspect according to any one of the preceding aspects the at least one auxiliary notch (340) is defined on a preponderant part of the peripheral zone (30*a*) of the overlap zone. In an aspect according to any one of the preceding aspects the at least one auxiliary notch (340) is defined over at least 50%, optionally at least 70%, of the extension of the peripheral zone (30*a*) of the overlap zone.

In an aspect according to any one of the preceding aspects the at least one auxiliary notch (340) extends along a trajectory which, for at least a section, is parallel to the trajectory (T1) of extension of the series of notches (330). In an aspect according to any one of the preceding aspects the at least one auxiliary notch (340) comprises a single continuous cut.

In an aspect according to any one of the preceding aspects the trajectory (T1) of the series of notches (330) is interposed between the trajectory of the auxiliary notch (340) and the perimeter edge (32*a*) of the overlap zone. In an aspect according to any one of the preceding aspects, the trajectory of the auxiliary notch (340) is concentric to the trajectory (T1) of the series of notches (330). In an aspect according to any one of the preceding aspects the trajectory of the auxiliary notch (340) has a curvilinear conformation, having concavity facing the central zone (30*b*) of the overlap zone. In an aspect according to any one of the preceding aspects, the extension trajectory of the auxiliary notch (340) has a "U", "C" or "V" shape.

In an aspect according to any one of the preceding aspects the at least one auxiliary notch (340) includes: at least one first auxiliary notch (340*a*) arranged to the side of the series of notches (330), and at least a second auxiliary notch (340*b*) placed alongside the first auxiliary notch (340*a*) so that the latter is interposed between the series of notches (330) and the second auxiliary notch (340*b*).

In one aspect according to the preceding aspect the first and second auxiliary notches (340*a*, 340*b*) are next to each other. In an aspect according to any one of the preceding aspects the first and second auxiliary notches (340*a*, 340*b*) are substantially concentric proceeding from the perimeter edge (32*a*) toward the central zone of the overlap zone. In one aspect according to any one of the preceding aspects, the first and second auxiliary notches (340*a*, 340*b*) are substantially identical to each other in shape. In an aspect according to any one of the preceding aspects the first and second auxiliary notches (340*a*, 340*b*) extend along respective trajectories parallel to each other.

In one aspect according to any one of the preceding aspects the plurality of notches (33) includes: at least one first continuous notch (350) defined on the peripheral zone (30*a*) of the overlap zone which is spaced from the perimeter edge (32*a*) of the second constraining portion (32), and at least a second continuous notch (360) defined on the peripheral zone (30*a*) of the overlap zone which is spaced from the perimeter edge (32*a*) of the second constraining portion (32), wherein the second notch (360) is placed to the side of the first notch (350) such that said first notch (350) is at least partially interposed between said second notch (360) and the perimeter edge (32*a*) of the second constraining portion (32).

In an aspect according to any one of the preceding aspects the first notch (350) is at least partially countershaped to the perimeter edge (32*a*) of the second constraining portion (32). In an aspect according to any one of the preceding aspects the first and second notches (350, 360) are placed concentrically to each other.

In an aspect according to any one of the preceding aspects the first notch (350) extends for a preponderant part of the extension of the perimeter edge (32*a*). In an aspect according to any one of the preceding aspects, the first notch (350) extends at least 50%, optionally at least 70%, of the extension of the perimeter edge (32*a*) of the second constraining portion (32). In an aspect according to any one of the preceding aspects, the first notch (350) is defined over a preponderant part of the peripheral zone (30*a*) of the overlap zone. In an aspect according to any one of the preceding aspects the first notch (350) is defined over at least 50%, optionally at least 70%, of the extension of the peripheral zone (30*a*) of the overlap zone. In an aspect according to any one of the preceding aspects, the first notch (350) extends along a trajectory which, for at least a section, is parallel to a respective extension trajectory of the second notch (360). In an aspect according to any one of the preceding aspects, the first notch (350) comprises a single continuous cut. In an aspect according to any one of the preceding aspects the extension trajectory of the first notch (350) has a curvilinear conformation, having concavity facing the central zone (30*b*) of the overlap zone. In an aspect according to any one of the preceding aspects the extension trajectory of the first notch (350) has a "U", "C" or "V" shape.

In one aspect according to the preceding aspect the first and second notches (350, 360) are next to each other. In an aspect according to any one of the preceding aspects the first and second notches (350, 360) are substantially concentric proceeding from the perimeter edge (32*a*) toward the central zone of the overlap zone. In one aspect according to any one of the preceding aspects the first and second notches (350, 360) are substantially identical to each other in shape. In an aspect according to any one of the preceding aspects the first and second notches (350, 360) extend along respective trajectories parallel to each other.

In an aspect according to any one of the preceding aspects the second notch (360) is at least partially countershaped to the perimeter edge (32*a*) of the second constraining portion (32). In an aspect according to any one of the preceding aspects the second notch (360) extends for a preponderant part of the extension of the perimeter edge (32*a*). In an aspect according to any one of the preceding aspects, the second notch (360) extends for at least 50%, optionally for at least 70%, of the extension of the perimeter edge (32*a*) of the second constraining portion (32). In an aspect according to any one of the preceding aspects, the second notch (360) is defined over a preponderant part of the peripheral zone (30*a*) of the overlap zone. In an aspect according to any one of the preceding aspects the second notch (360) is defined over at least 50%, optionally at least 70%, of the extension of the peripheral zone (30*a*) of the overlap zone. In an aspect according to any one of the preceding aspects, the second notch (360) comprises a single continuous cut. In an aspect according to any one of the preceding aspects the extension trajectory of the second notch (360) has a curvilinear conformation, having concavity facing the central zone (30*b*) of the overlap zone. In an aspect according to any one of the preceding aspects the extension trajectory of the second notch (360) has a "U", "C" or "V" shape.

At least part, optionally all, the notches of the series of notches is passing through the thickness of the second constraining portion.

In an aspect according to any one of the preceding aspects the first and second constraining portions (31, 32) are engaged by means of at least one of: one or more portions of glue, optionally cold glue, and one or more portions of adhesive material, optionally strips of adhesive material (331 in FIG. 7*a*), arranged at the peripheral zone (30 *a*) overlapping the plurality of notches (33). In an aspect according to the preceding aspect, the glued and/or the adhesive portion covers all the peripheral zone affected by the notches. In an aspect according to any one of the preceding aspects, the glued and/or the adhesive portion is arranged at the peripheral zone (30 *a*) affected by the plurality of notches (33). In an aspect according to the preceding aspect, the glued and/or the adhesive portion covers all the peripheral zone affected by the notches. In an aspect according to any one of the preceding aspects, the glued and/or the adhesive portion is arranged at the peripheral zone (30 *a*) affected by the plurality of notches (33) and at least partially at the central zone (30 *b*).

arranged at the peripheral zone (30*a*) overlapping the plurality of notches (33). In an aspect according to the preceding aspect, the glued and/or the adhesive portion covers all the peripheral zone affected by the notches. In an aspect according to any one of the preceding aspects, the glued and/or the adhesive portion is arranged at the peripheral zone (30*a*) affected by the plurality of notches (33) and at least partially at the central zone (30*b*).

In an aspect according to any one of the preceding aspects the sheet material of the second constraining portion (32) extends in thickness between: a first surface facing and at least partly in contact with the first constraining portion (31), and a second surface suitable for defining at least part of an outer surface of the container (1), wherein at least part, optionally all, the plurality of notches (33) is passing through the thickness of the second constraining portion.

In an aspect according to any one of the preceding aspects the sheet material of the storage (2) wraps at least partially around itself to form said overlap zone. In an aspect according to any one of the preceding aspects, the storage (2) comprises a bottom wall (4*f*) from which the at least one side wall of the storage (2) emerges. In an aspect according to any one of the preceding aspects the storage (2) has a single passage opening opposed to the bottom wall (4*f*). In an aspect according to any one of the preceding aspects the at least one side wall of the storage (2) comprises at least one front wall (4*a*) and at least one opposed rear wall (4*b*) connected by means of at least one first and at least one second side wall (4*c*, 4*d*). In one aspect according to the preceding aspect, the front wall (4*a*) and the rear wall (4*b*) of the storage are facing each other. In an aspect according to any one of the preceding aspects the front wall (4*a*) and the rear wall (4*b*) of the storage are parallel to each other. In an aspect according to any one of the preceding aspects the first and second side walls (4*c*, 4*d*) of the storage (2) are facing each other and spaced apart by means of the front wall (4*a*) and the rear wall (4*b*) of the same storage (2).

In an aspect according to any one of the preceding aspects the front wall (4*a*) of the storage (2) has a substantially square or rectangular or trapezium shape. In an aspect according to any one of the preceding aspects the rear wall (4*b*) of the storage (2) has a substantially square or rectangular or trapezium shape. In an aspect according to any one of the preceding aspects the first side wall (4*c*) of the storage (2) has a substantially square or rectangular or trapezium shape. In an aspect according to any one of the preceding aspects the second side wall (4*d*) of the storage (2) has a substantially square or rectangular shape or a trapezium shape. In an aspect according to any one of the preceding aspects the front wall (4*a*) and the rear wall (4*b*) of the storage (2) have substantially the same shape, optionally having the same shape and size. In an aspect according to any one of the preceding aspects the first and second side walls (4*c*, 4*d*) of the storage (2) have substantially the same shape, optionally have the same shape and size.

In an aspect according to any one of the preceding aspects the storage (2) includes at least one overlap zone. In an aspect according to any one of the preceding aspects the first side wall (4*c*) of the storage (2) has said overlap zone. In an aspect according to any one of the preceding aspects the first and second side walls (4*c*, 4*d*) of the storage (2) have said overlap zone. In an aspect according to any one of the preceding aspects the front wall (4*a*) and the rear wall (4*b*) of the storage (2) are devoid of said overlap zone.

In an aspect according to any one of the preceding aspects the first side wall (4*c*) has a square or rectangular shape, wherein the plurality of notches (33) is defined in correspondence of at least 2, optionally at least 3 sides of the first side wall (4*c*). In an aspect according to any one of the preceding aspects, the plurality of notches (33) is defined at the side of the first side wall (4*c*) directly engaged to the bottom wall (4*f*) and at the at least one, optionally both, sides immediately adjacent to side directly engaged to the bottom wall (4*f*) and opposed to each other.

In an aspect according to any one of the preceding aspects the second side wall (4*d*) has a square or rectangular shape, wherein the plurality of notches (33) is defined in correspondence of at least 2, optionally at least 3, sides of the second side wall (4*d*). In an aspect according to any one of the preceding aspects, the plurality of notches (33) is defined at the side of the second side wall (4*d*) directly engaged to the bottom wall (4*f*) and at the at least one, optionally both, sides immediately adjacent to side directly engaged to the bottom wall (4*f*) and opposed to each other.

In an aspect according to any one of the preceding aspects, the closure system (7) defines an inner volume (7*f*) and includes at least one side wall defining an access delimited by a respective free edge (7*b*) configured for receiving in passage, in the closed condition, said storage (2).

In an aspect according to any one of the preceding aspects the closure system (7) is engaged at the free edge (6) of storage (2) and movable by rotation, relative to said storage (2) between the open condition and the closed condition, and vice versa. In an aspect according to any one of the preceding aspects, the closure system (7) is hinged to the free edge (6) of the storage (2). In an aspect according to any one of the preceding aspects, the closure system (7) includes at least one top wall (7*a*) engaged to the free edge (6) of the storage (2) and at least one inserting portion configured to flank, in the closed condition, to at least one side wall of the storage (2). In an aspect according to any one of the preceding aspects, the top portion (7*a*) of the closure system (7) defines a container closure wall (1) configured to occlude, in the closed condition of the closure system (7), the passage opening.

In one aspect according to any one of the preceding aspects, the closure system (7) includes a front wall (8*a*) emerging from the top wall (7*a*), wherein the closure system (7) also includes a first and second side wall (8*c*, 8*d*), opposed to each other, also emerging from the top wall (7*a*) on the same side as the front wall (8*a*), wherein the first and second side walls (8*c*, 8*d*) of the closure system (7) are connected to each other by means of the front wall (8*a*) of the same closure system (7). In an aspect according to any one of the preceding aspects, the front wall (8*a*), the first side wall (8*c*) and the second side wall (8*d*) together with the top wall (7*a*) of the closure system (7) delimit an inner volume (7*f*) suitable for housing, in the closed condition of the closure system (7), at least partially the storage (2).

In one aspect according to any one of the preceding aspects in the closed condition of the container (1):

- the respective front walls (4*a*, 8*a*) of the storage and of the closure system are directly facing each other,
- the respective first side walls (4*c*, 8*c*) of the storage and of the closure system are directly facing each other,
- the respective second side walls (4*b*, 8*d*) of the storage and of the closure system are directly facing each other.

In an aspect according to any one of the preceding aspects, the top wall (7*a*) of the closure system (7), in the closed condition of the container (1), is configured to contact and rest on at least part of the free edge (6) of the storage (2).

In one aspect according to any one of the preceding aspects the closure system (7) is distinct and completely separable from storage (2). In one aspect according to any one of the preceding aspects the closure system (7) and the storage (2) are movable with respect to each other at least between:

- the closed condition where the storage is at least partially housed in the closure system (7), which prevents the communication between the compartment (3) of storage (2) and the external environment,
- the open condition where the closure system (7) and the storage are completely separated and the compartment of the storage is in communication with the external environment.

In an aspect according to any one of the preceding aspects, the closure system (7) comprises a top wall (7*a*) and a predetermined number of side walls emerging from the top wall (7*a*) to define an inner volume (7*f*) suitable for housing, in the closed condition, at least part of the storage (2). In an aspect according to any one of the preceding aspects, the closure system (7) is at least partially countershaped to the storage (2). In an aspect according to any one of the preceding aspects the storage (2), in the closed condition, is entirely housed in the closure system (7), optionally in the inner volume of the closure system (7).

In an aspect according to any one of the preceding aspects the closure system (7) includes a front wall (8*a*) and a rear wall (8*b*) opposed to the front wall (8*a*), the closure system (7) further including a first and a second side wall (8*c*, 8*d*) also opposed to each other and connecting the front wall (8*a*) and the rear wall (8*b*). In an aspect according to any one of the preceding aspects, the front wall (8*a*), the rear wall (8*b*), the first side wall (8*c*) and the second side wall (8*d*) of the closure system (7) delimit, in cooperation with the top wall (7*a*), the inner volume (7*f*) of the closure system (7) suitable for housing, in the closed condition, at least part of the storage (2). In an aspect according to any one of the preceding aspects, the free edge (6) of the storage (2), in the closed condition, is configured to at least partially contact the top wall (7*a*) of the closure system.

In one aspect according to any one of the preceding aspects, the front wall (8*a*), the rear wall (8*b*), the first side wall (8*c*) and the second side wall (8*d*) of the closure system (7) define an access delimited by a respective free edge (7*b*) and configured for allowing the passage of the storage during the transition from the open to the closed condition of the container (1).

In an aspect according to any one of the preceding aspects the free edge (6) of the storage (2), in the closed condition, is placed in proximity, optionally at least partly in contact, with the top wall (7*a*) of the closure system (7). In an aspect according to any one of the preceding aspects the bottom wall (4*f*) of the storage (2), in the closed condition, is placed in proximity of the free edge (7*d*) of the access of the closure system (7).

In one aspect according to any one of the preceding aspects, in the closed condition:

- the respective front walls (4*a*, 8*a*) of the storage and of the closure system are directly facing each other,
- the respective rear walls (4*b*, 8*b*) of the storage and of the closure system are directly facing each other,
- the respective first side walls (4*c*, 8*c*) of the storage and of the closure system are directly facing each other,
- the respective second side walls (4*d*, 8*d*) of the storage and of the closure system are directly facing each other.

In one aspect according to any one of the preceding aspects, the prefixed number of side walls of the closure system (7) is at least partly countershaped to the prefixed number of the side walls of the storage (2).

In an aspect according to any one of the preceding aspects the closure system (7) wraps at least partially around itself to form said overlap zone. In an aspect according to any one of the preceding aspects the front wall (8*a*) of the closure system (7) has a substantially square or rectangular or trapezium shape. In an aspect according to any one of the preceding aspects the rear wall (8*b*) of the closure system (7) has a substantially square or rectangular shape or a trapezium shape. In an aspect according to any one of the preceding aspects the first side wall (8*c*) of the closure system (7) has a substantially square or rectangular or trapezium shape. In an aspect according to any one of the preceding aspects the second side wall (8*d*) of the closure system (7) has a substantially square or rectangular or trapezium shape. In an aspect according to any one of the preceding aspects the front wall (8*a*) and the rear wall (8*b*) of the closure system (7) have substantially the same shape, optionally having the same shape and size. In an aspect according to any one of the preceding aspects, the first and second side walls (8*c*, 8*d*) of the closure system (7) have substantially the same shape, optionally have the same shape and size.

In an aspect according to any one of the preceding aspects the closure system (7) includes at least one overlap zone. In an aspect according to any one of the preceding aspects the first side wall (8*c*) of the closure system (7) has said overlap zone. In an aspect according to any one of the preceding aspects the first and second side walls (8*c*, 8*d*) of the closure system (7) have said overlap zone. In an aspect according to any one of the preceding aspects the front wall (8*a*) and the rear wall (8*b*) of the closure system (7) are devoid of said zone of overlap.

In an aspect according to any one of the preceding aspects the first side wall (8*c*) has a square or rectangular shape, wherein the plurality of notches (33) is defined in correspondence of at least 2, optionally at least 3, sides of the first side wall (8*c*) of the closure system (7). In an aspect according to any one of the preceding aspects, the plurality of notches (33) is defined at the side of the first side wall (8*c*) of the closure system (7) directly engaged to the top wall (7*a*) of the closure system (7) and at the at least one, optionally both, sides immediately adjacent to side directly engaged to the top wall (7*a*) and opposed to each other.

In an aspect according to any one of the preceding aspects the second side wall (8*d*) of the closure system (7) has a square or rectangular shape, wherein the plurality of notches (33) is defined in correspondence of at least 2, optionally at least 3, sides of the second side wall (8*d*) of the closure system (7). In an aspect according to any one of the preceding aspects, the plurality of notches (33) is defined at the side of the second side wall (8*d*) of the closure system (7) directly engaged to the top wall (7*a*) and at the at least one, optionally both, sides immediately adjacent to side directly engaged to the top wall (7*a*) and opposed to each other.

In an aspect according to any one of the preceding aspects the first and second coupling portions (12, 13), in the locking condition, are engaged externally to the compartment (3) of the storage (2). In an aspect according to any one of the preceding aspects the first and second coupling portions (12, 13), in the locking condition, are engaged within the closure system (7).

In an aspect according to any one of the preceding aspects, the first and second coupling portions (12, 13), in the locking condition, are both arranged in the compartment (3) of storage (2).

In an aspect according to any one of the preceding aspects the second coupling portion (13) is devoid of weakening portions configured for allowing easing the breaking of the second coupling portion (13) itself. In an aspect according to any one of the preceding aspects the second coupling portion (13) is joined in one piece to the storage (2). In an aspect according to any one of the preceding aspects the second coupling portion (13) is stably carried by the storage (2), wherein between the second coupling portion (13) and the storage (2) there are no weakened portions configured for easing the separation of the second coupling portion (13) from the storage (2).

In an aspect according to any one of the preceding aspects, the first coupling portion (12) is devoid of weakening portions configured for easing the breaking of the first coupling portion (12) itself. In an aspect according to any one of the preceding aspects the first coupling portion (12) is joined in one piece to the closure system (7). In an aspect according to any one of the preceding aspects the first coupling portion (12) is stably carried by the closure system (7), wherein between the first coupling portion (12) and the closure system (7) there are no weakened portions configured for easing the separation of the first coupling portion (12) from the closure system (7).

In an aspect according to any one of the preceding aspects, the first coupling portion (12) is carried by at least one side wall of the closure system (7). In an aspect according to any one of the preceding aspects the first coupling portion (12) comprises at least one tab (12*a*) carried by at least one side wall of the closure system (7). In an aspect according to any one of the preceding aspects, the tab (12*a*) of the first coupling portion (12) defines an undercut suitable for engaging, in the closed condition of the closure system and of the storage, the second coupling portion (13) for defining said locking condition.

In an aspect according to any one of the preceding aspects the first coupling portion (12) is at least carried by the front wall (8*a*) of the closure system (7). In an aspect according to any one of the preceding aspects the first coupling portion (12) is carried by the front wall (8*a*) and the rear wall (8*b*) of the closure system (7).

In an aspect according to any one of the preceding aspects the first coupling portion (12) is entirely arranged in the inner volume (7*f*) of the closure system (7). In an aspect according to any one of the preceding aspects the first coupling portion (12) is spaced from the free edge (7*b*) of the closure system (7). In an aspect according to any one of the preceding aspects the first coupling portion (12) is interposed between the top wall (7*a*) and the free edge (7*b*) of the closure system (7).

In an aspect according to any one of the preceding aspects, the closure system (7) has a first coupling portion (12) carried by the front wall (8*a*) of the closure system (7) and a second coupling portion (12) carried by the rear wall (8*b*) of the closure system (7). In an aspect according to any one of the preceding aspects, the perimeter edge (12*b*) of each first coupling portion (12) is arranged in interposition between the top wall (7*a*) and the free edge (7*b*) of the closure system (7). In an aspect according to any one of the preceding aspects, the tab (12*a*) of each first coupling portion (12) is entirely arranged in the inner volume (7*f*) of the closure system (7).

In an aspect according to any one of the preceding aspects the tab (12*a*) of the first coupling portion (12) is made of sheet material, optionally paper. In an aspect according to any one of the preceding aspects the tab (12*a*) of the first coupling portion (12) has a rectangular shape or a square shape or a trapezium shape. In an aspect according to any one of the preceding aspects, the tab (12*a*) of the first coupling portion (12) is delimited by a perimeter edge (12*b*), spaced from the free edge (7*b*) of the closure system (7). In an aspect according to any one of the preceding aspects, the perimeter edge (12*b*) of the tab (12*a*) has at least one sloping section with respect to a section of the free edge of the closure system (7) defined by the side wall directly carrying said tab (12*a*). In an aspect according to any one of the preceding aspects, at least the section of the perimeter edge (12*b*) of the tab (12*a*) of the first coupling portion (12) is inclined with respect to the free edge (7*b*) of the closure system by an angle comprised between 20° and 80°, optionally by an angle comprised between 30° and 70°. In an aspect according to any one of the preceding aspects, the perimeter edge (12*b*) of the tab (12*a*) of the first coupling portion (12) has a substantially "C" or "V" shape, the concavity of which faces the free edge (7*b*) of the closure system (7).

In an aspect according to any one of the preceding aspects the second coupling portion (13) comprises at least one tab (13*a*) carried by at least one side wall of the storage. In an aspect according to any one of the preceding aspects the tab (13*a*) of the second coupling portion (13) emerges from at least one storage wall according to a direction exiting the compartment (3). In an aspect according to any one of the preceding aspects, the tab (13*a*) of the second coupling portion (13) is placed entirely outside the compartment (3) of the storage. In an aspect according to any one of the preceding aspects, the tab (13*a*) of the second coupling portion (13) protrudes from a side wall of the storage (2) from an attachment portion (13*c*) spaced from the free edge (6) of the storage. In an aspect according to any one of the preceding aspects, the tab (13*a*) of the second coupling portion (13) extends from the attachment portion (13*c*) to an end portion (13*d*) opposed to the attachment portion (13*c*). In an aspect according to the preceding aspect, at least the end portion (13*b*) of the tab (13*a*) is spaced from the side wall of the storage (2) directly carrying said tab (13*a*).

In an aspect according to any one of the preceding aspects, the tab (13*a*) of the second coupling portion (13) defines at least one undercut suitable for engaging the first coupling portion (12) to define said locking condition of the container (1).

In an aspect according to any one of the preceding aspects, the tab (13*a*) of the second coupling portion (13) is delimited by a perimeter edge (13*b*). In an aspect according to the preceding aspect at least one section of the perimeter edge (13*b*), in the locking condition, is configured for contacting the first coupling portion (12) of the closure system (7).

In an aspect according to any one of the preceding aspects, the undercut defined by the tab (13*a*) of the second coupling portion (13), in the locking condition, is stably engaged to the tab (12*a*) of the first coupling portion (12) to define said locking condition.

In an aspect according to any one of the preceding aspects, the tab (13*a*) of said second coupling portion (13) has a substantially rectangular or triangular or substantially trapezium or "V" or "C" shape. In an aspect according to any one of the preceding aspects, at least a section of the perimeter edge (13*b*) of the tab (13*a*) of said second coupling portion (13) is sloped with respect to the free edge (6) of the passage opening of the storage (2). In an aspect according to any one of the preceding aspects at least one section of the perimeter edge (13*b*) of the tab (13*a*) is sloped with respect to the free edge (6) by an angle comprised between 20° and 80°, optionally by an angle comprised between 30° and 70°. In an aspect according to any one of the preceding aspects the tab (13*a*) of the second coupling portion (13) is sloped with respect to the side wall of the storage (2) to which it is engaged by an angle comprised between 1° and 30°; optionally said angle being measured between facing surfaces of the tab (13*a*) and the side wall of the storage (2) directly carrying (optionally joined in one piece) said tab (13*a*).

In an aspect according to any one of the preceding aspects the at least one second coupling portion (13) of storage (2) is defined in interposition between the bottom wall (4*f*) and the free edge (6) of storage (2).

In an aspect according to any one of the preceding aspects, the container (1) includes at least two second coupling portions (13). In an aspect according to any one of the preceding aspects, the container includes a second coupling portion (13) carried by the front wall (4*a*) of the storage (2) and a second coupling portion (13) carried by the rear wall (4*b*) of the storage (2).

In an aspect according to any one of the preceding aspects the second coupling portion (13) carried by the front wall (4*a*) of the storage (2), in the locking condition, is configured for stably engaging the first coupling portion (12) carried by the front wall (8*a*) of the closure system (7) for defining said locking condition. In an aspect according to any one of the preceding aspects, the second coupling portion (13) carried by the rear wall (4*b*) of the storage (2), in the locking condition, is configured for stably engaging the first coupling portion (12) carried by the rear wall (8*b*) of the closure system (7) for defining said locking condition. In an aspect according to any one of the preceding aspects, the container (1) includes a second coupling portion (13) for each first coupling portion (12). In an aspect according to any one of the preceding aspects the second coupling portions (13) are engaged to respective side walls of the storage (2) opposed to each other.

In an aspect according to any one of the preceding aspects, the closure system (7) includes, at the free edge (7*b*) at least a lowered section (7*c*) defining a through opening configured for allowing the user, in the closed condition, to contact the side wall of the storage.

In an aspect according to any one of the preceding aspects at least one of the closure system (7) and the storage (2) comprises at least one release portion (60) configured for allowing, at least in the locking condition, the disengagement of the at least one first coupling portion (12) and the at least one second coupling portion (13). In an aspect according to any one of the preceding aspects, the release portion (60) is configured for defining at least one through access (61) on at least one side wall of the at least one closure system (7). In an aspect according to any one of the preceding aspects, the release portion (60) is configured for allowing, at least in the locking condition, to act—manually and/or by means of an opening device—from outside the container (1) on at least one of said first and second coupling portions (12, 13) for allowing disengagement thereof and thereby allowing the closure system (7) and storage (2) to switch from the closed condition to the open condition. In an aspect according to any one of the preceding aspects, the release portion (60), in the locking condition, is arranged at the first and second coupling portions (12, 13). In an aspect according to any one of the preceding aspects, the release portion (60) comprises at least one through access (61) defined on at least one side wall of the closure system (7). In an aspect according to any one of the preceding aspects, the release portion (60), optionally the through access (61), is configured for allowing, at least in the locking condition, to act (optionally manually and/or by means of an opening device) from outside the container (1) directly on the second coupling portion (13). In an aspect according to any one of the preceding aspects, the second coupling portion (13) is at least partially facing the through access (61) of the release portion (60). In an aspect according to any one of the preceding aspects, the tab (13*a*) of the second coupling portion (13), in the locking condition, is directly facing the through access (61) of the release portion (60).

In an aspect according to any one of the preceding aspects, the container includes a release portion (60) defined on the front wall (8*a*) of the closure system (7) and configured for allowing a user to manually act directly on the tab (13*a*) of the second coupling portion (13) defined on the front wall (4*a*) of the storage (2) for allowing it to be disengaged with the tab (12*a*) of the first coupling portion (12) carried by the front wall (8*a*) of the closure system (7). In an aspect according to any one of the preceding aspects, the through access (61) of the release portion is defined on the front wall (8*a*) of the closure system (7). In an aspect according to any one of the preceding aspects the second coupling portion (13), optionally the tab (13*a*) of the second coupling portion (13), carried by the front wall of the storage (2), in the locking condition, is interposed between the release portion (60) and the first coupling portion (12) carried by the front wall (8*a*) of the closure system (7).

In one aspect a process of making a container (1) according to any one of the preceding aspects is provided. In one aspect according to the preceding aspect the closure system (7) is made by folding a first blank (50) made of sheet material. In an aspect according to any one of the preceding process aspects the first blank (50) is made of paper sheet material. In an aspect according to any one of the preceding process aspects the first blank (50) is made by die-cutting a flat sheet material.

In an aspect according to any one of the preceding process aspects the first blank (50) includes:

a central sheet (51), a predetermined number of side sheets (52) joined in one piece to the central sheet (51) and emerging from the latter from a perimeter edge.

In an aspect according to any one of the preceding process aspects the central sheet (51) has a polygonal profile, optionally rectangular or square. In one aspect according to any one of the preceding process aspects the side sheet (52) has a polygonal profile, optionally rectangular or square.

In an aspect according to any one of the preceding process aspects, the process comprises a sub-step of folding the predetermined number of side sheets (52) to define the predetermined number of side walls of the closure system (7). In an aspect according to any one of the preceding process aspects, the side sheets (52) are constrained to each other such that the closure system (7) maintains a three-dimensional shape, for example applying glue or an adhesive component.

In an aspect according to any one of the preceding process aspects the first blank (50) has at least one connecting sheet (55) joined in one piece to at least one of two immediately adjacent side sheets (52), wherein the process includes overlapping and bonding, for example by gluing of the connecting sheet (55) to at least one side sheet (52) such that, following the overlapping and bonding, the connecting sheet (55) can define the first constraining portion (31) of the overlap zone while the side sheet (52) can define the second constraining portion (32) of the overlap zone.

In an aspect according to any one of the preceding process aspects, one or more side sheets (52) comprise at least one passing-through notch (40), in particular a plurality of passing-through notches (40), made at a peripheral zone of the side sheet (52) overlapping and joined to the connecting sheet (55) such that said plurality of notches (40) of the first blank can define the plurality of notches (33) of the closure system (7). In an aspect according to any one of the preceding process aspects, the process involves arranging of one or more sets of passing-through notches (40).

In an aspect according to any one of the preceding process aspects the first blank (50) includes at least one peripheral sheet (53) engaged to at least one of said side sheets (52), wherein the process includes a step of overlapping the peripheral sheet (53) of the first blank (50) above the side sheet (52) and bonding, e.g., by a glue portion, to the same side sheet (52) to define said first coupling portion (12) of the closure system (7).

In an aspect according to any one of the preceding process aspects the first blank (50) includes two peripheral sheets (53) respectively emerging from a perimeter edge of at least one side sheet (52) on the opposite side from the central sheet (51).

In an aspect according to any one of the preceding process aspects the first blank (50) includes a respective passing-through notch (58) defined on the side sheet (52) of the first blank (50), wherein said passing-through notch (58) has either an open profile or a closed profile.

In an aspect according to any one of the preceding process aspects the passing-through (40) are made by a die-cutting or a laser cutting process, for example performed at the same time as the die-cutting or laser cutting stage of the first blank (50).

In aspect according to any one of the preceding process aspects the storage (2) is made by folding a second blank (70) made of flat sheet material. In an aspect according to any one of the preceding process aspects the second blank (70) is made of paper sheet material. In an aspect according to any one of the preceding process aspects the second blank (70) is made by die-cutting a flat sheet material.

In an aspect according to any one of the preceding process aspects the first blank (50) for making the closure system (7) is separate and distinct from the second blank (70) used for making the storage (2).

In one aspect according to any of the preceding aspects the second blank (70) includes:

a central sheet (71), a predetermined number of side sheets (72) joined in one piece to the central sheet (71) and emerging from the latter from a perimeter edge.

In an aspect according to any one of the preceding aspects the central sheet (71) has a polygonal profile, optionally rectangular or square. In an aspect according to any one of the preceding aspects the side sheet (72) has a polygonal profile, optionally rectangular or square. In an aspect according to any one of the preceding aspects, the process includes a step of folding the predetermined number of side sheets (72) to define the predetermined number of side walls of the storage (2). In an aspect according to any one of the preceding aspects, the side sheets (72) are directly engaged to each other by means of connecting sheets (75) that join in one piece two adjacent side sheets (72), for example by gluing.

In an aspect according to any one of the preceding aspects, the second blank (70) has a peripheral sheet (73) emerging from a perimeter edge of at least one side sheet (72), on the opposite side from the central sheet (71) of the same second blank (70). In an aspect according to any one of the preceding aspects, the process includes a step of folding the peripheral sheet (73) overlapping the side sheet (72) of the same second blank (70) and engaging it, for example by a glue portion, to said side sheet (72). In an aspect according to any one of the preceding aspects, the second blank (70) includes a passing-through notch (76) defined on one or more side sheets (72), wherein each passing-through notch has either a closed profile or an open profile.

In one aspect according to any one of the preceding aspects the second blank (70) can be obtained by means of one or more steps of die-cutting a single flat sheet or by one or more steps of laser cutting.

In one aspect a use of the container (1) according to any one of the preceding aspects is provided for the containment of at least one of the following products: drugs, cosmetics, cleaning products (e.g., laundry and dishwashing detergents), food, and tobacco products (e.g., cigars and cigarettes).

DESCRIPTION OF THE DRAWINGS

Some embodiments and some aspects of the invention will be described below with reference to the accompanying drawings, provided for illustrative purposes only and therefore not limiting wherein.

Figure 3:
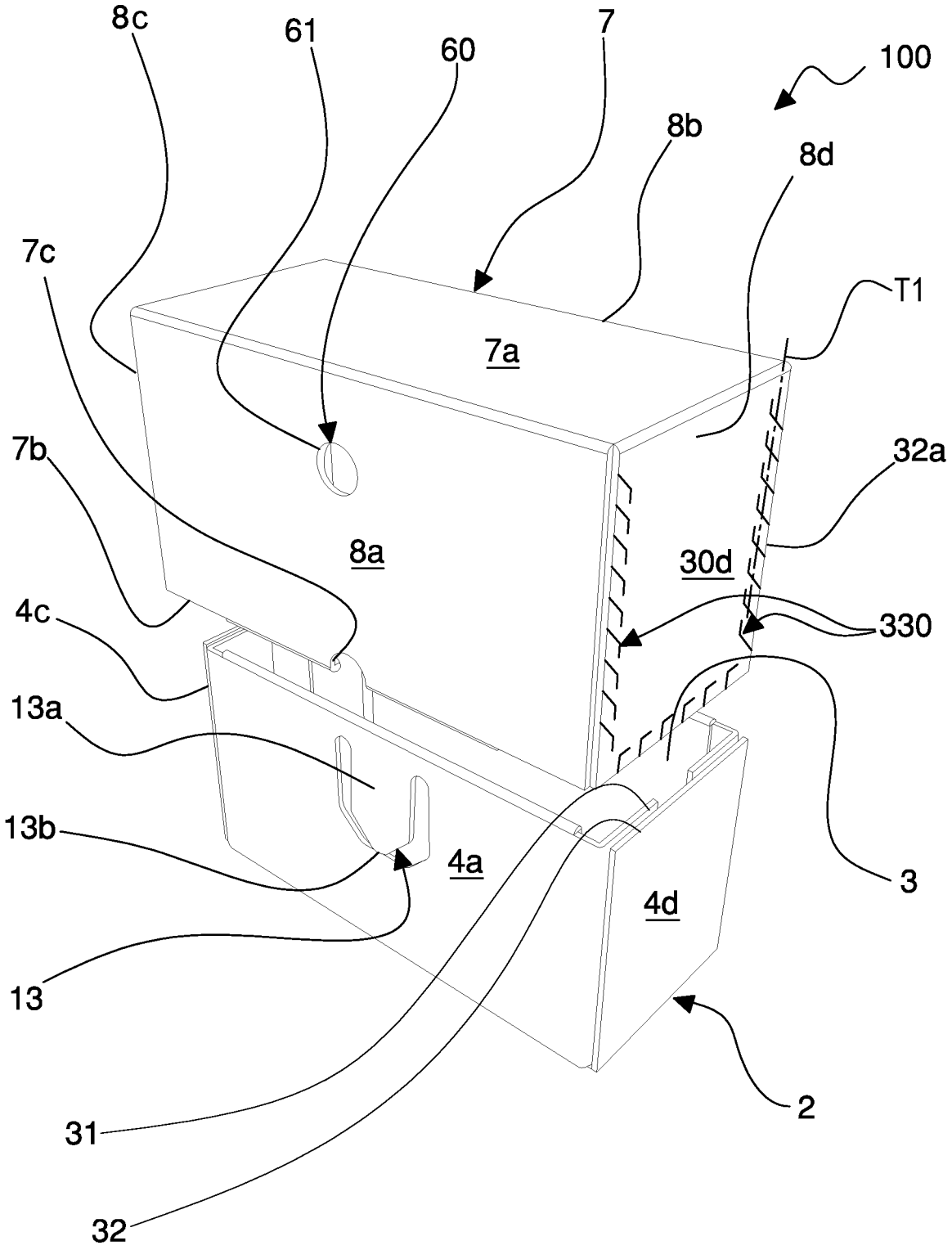
FIG. 3 is a perspective view of a container according to the present invention placed in an open condition.
Figure 7:
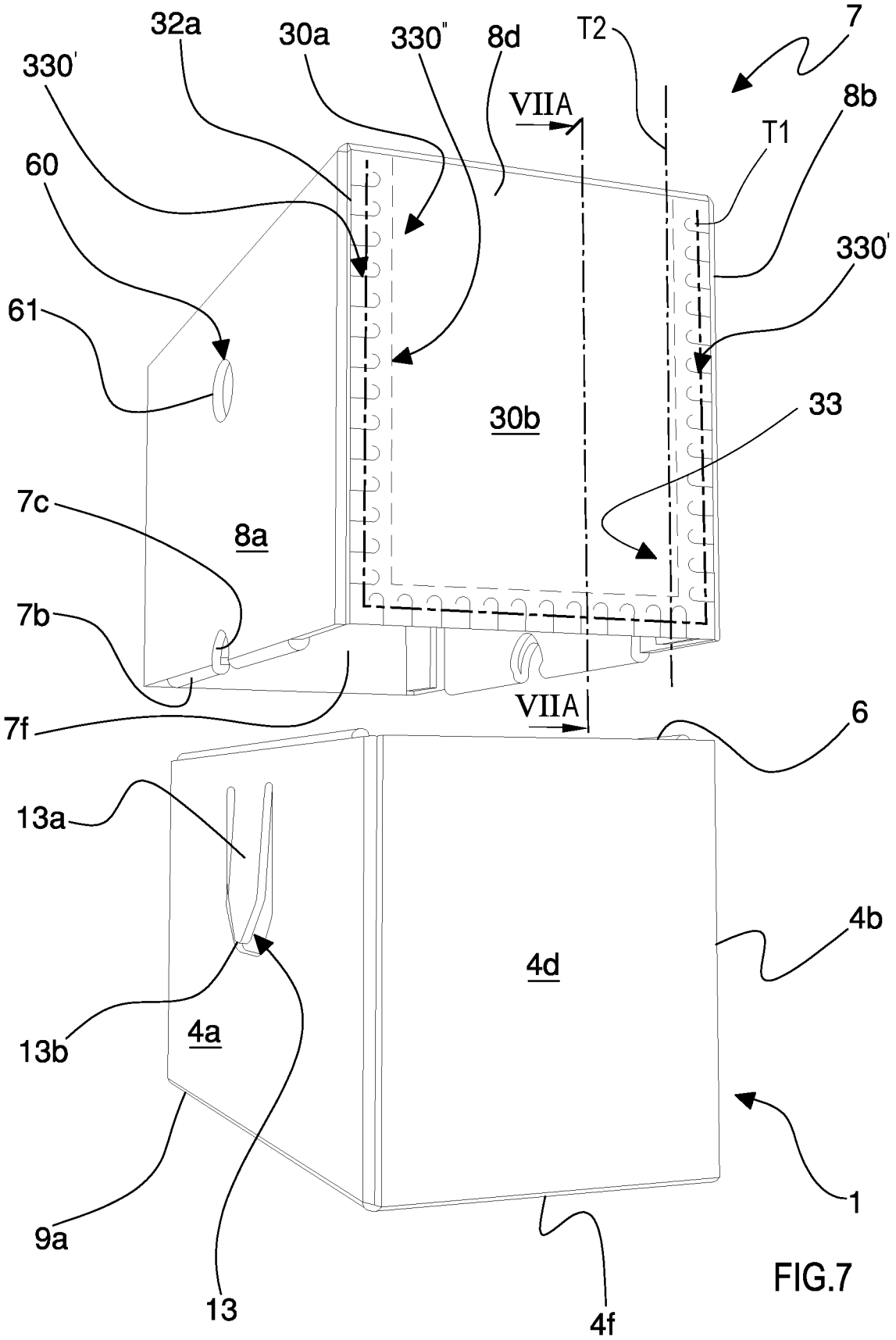
Figure 7A:
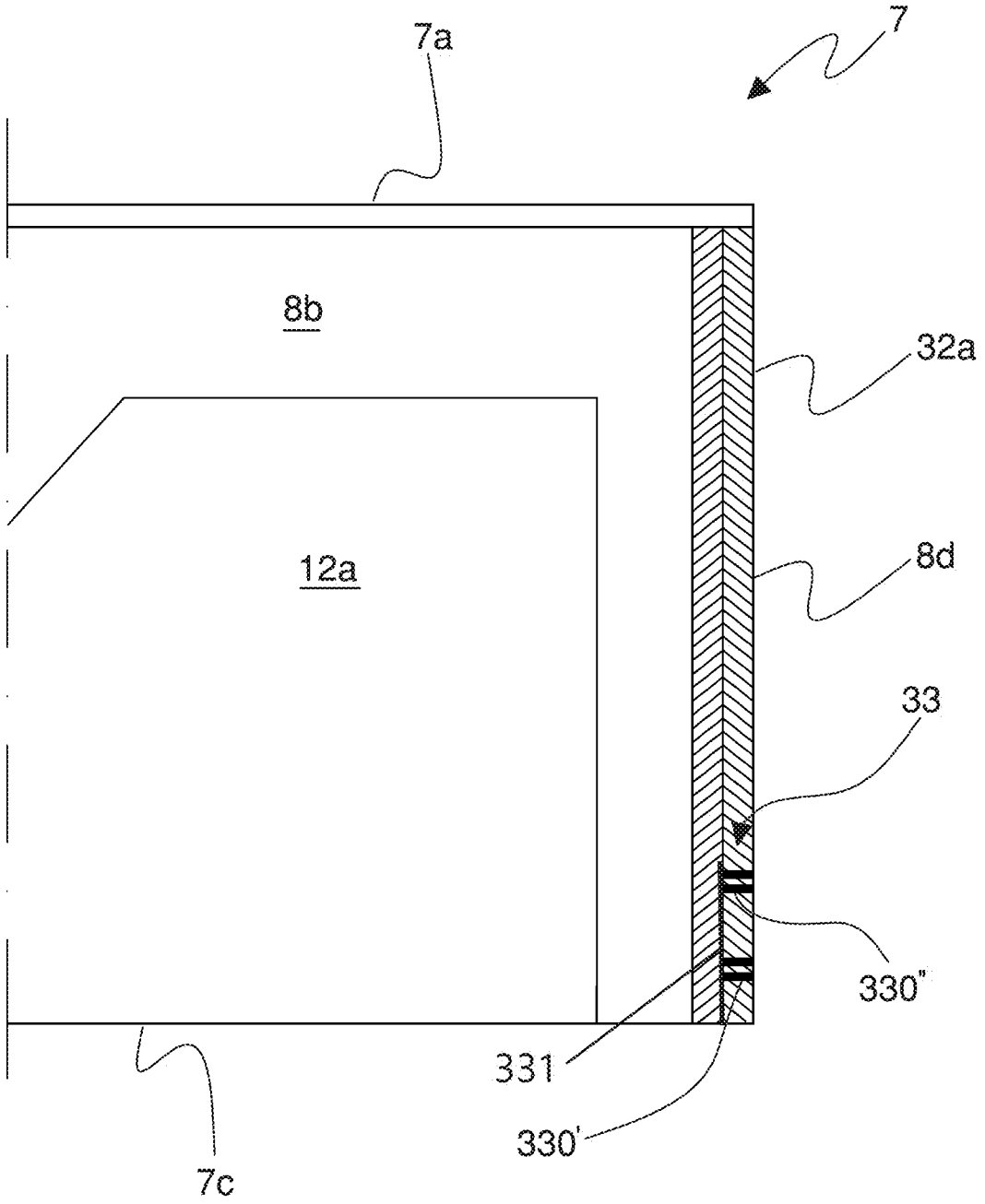
Figure 8:
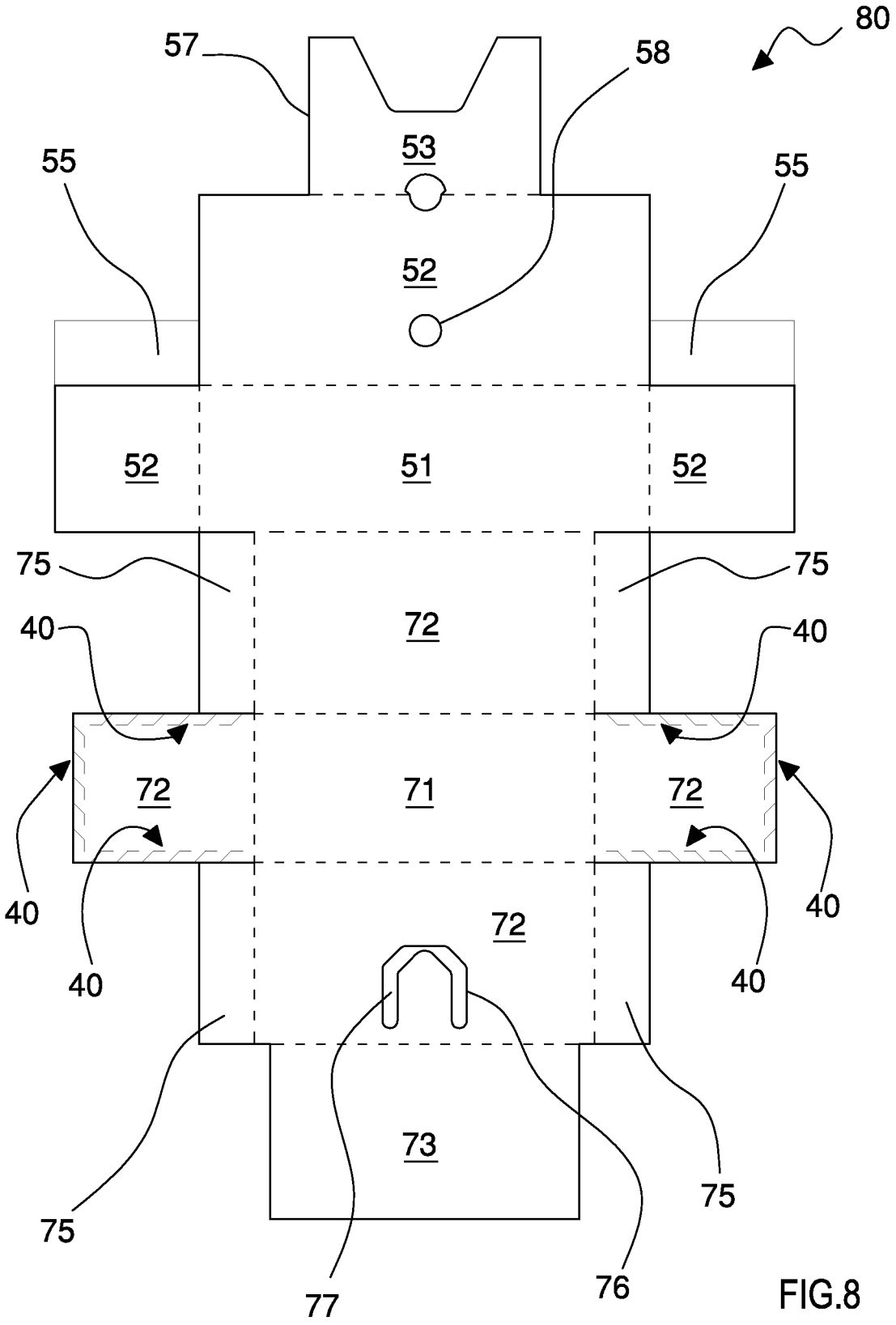
Figure 8A:
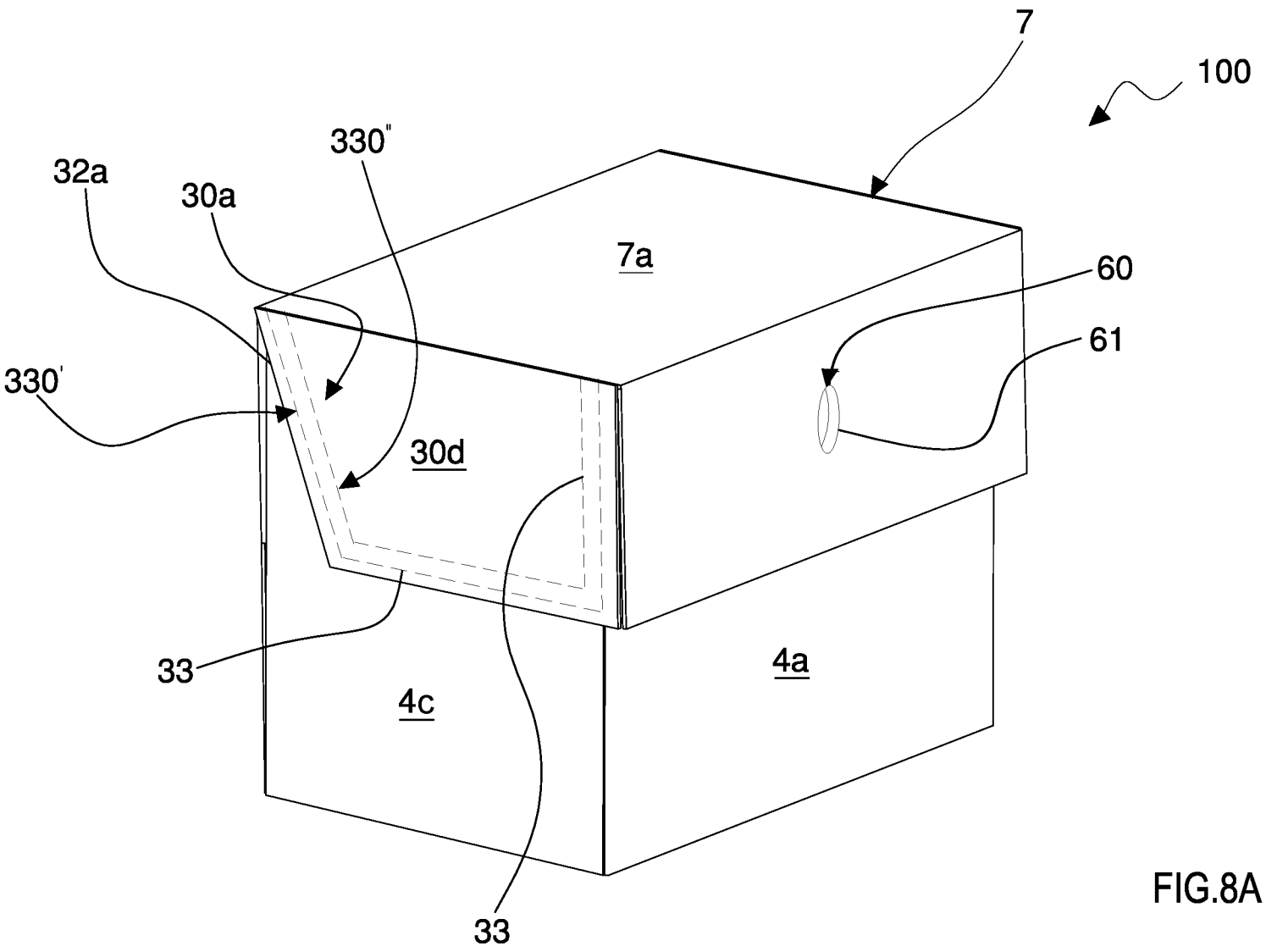
Figure 9:
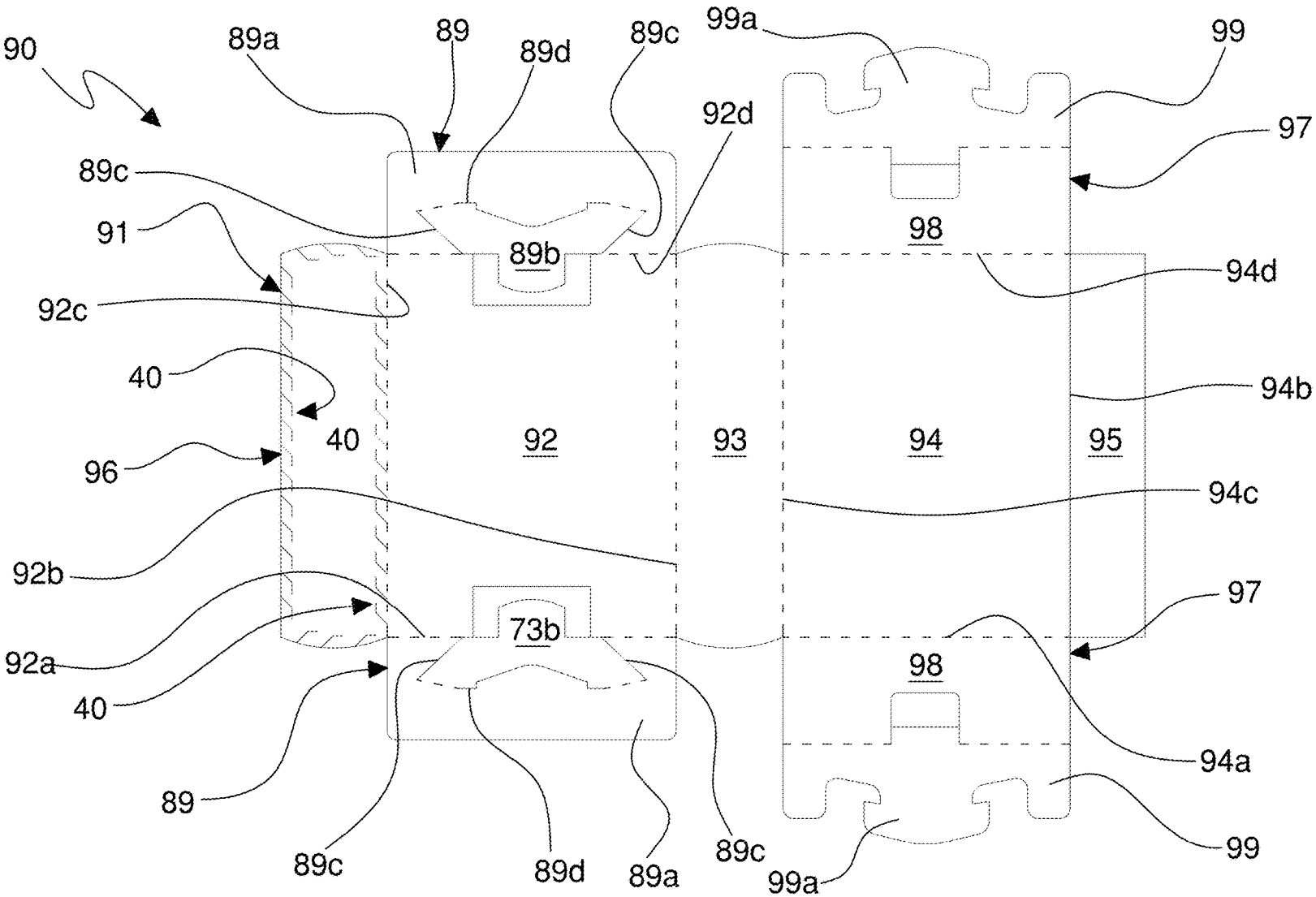
Figure 9A:
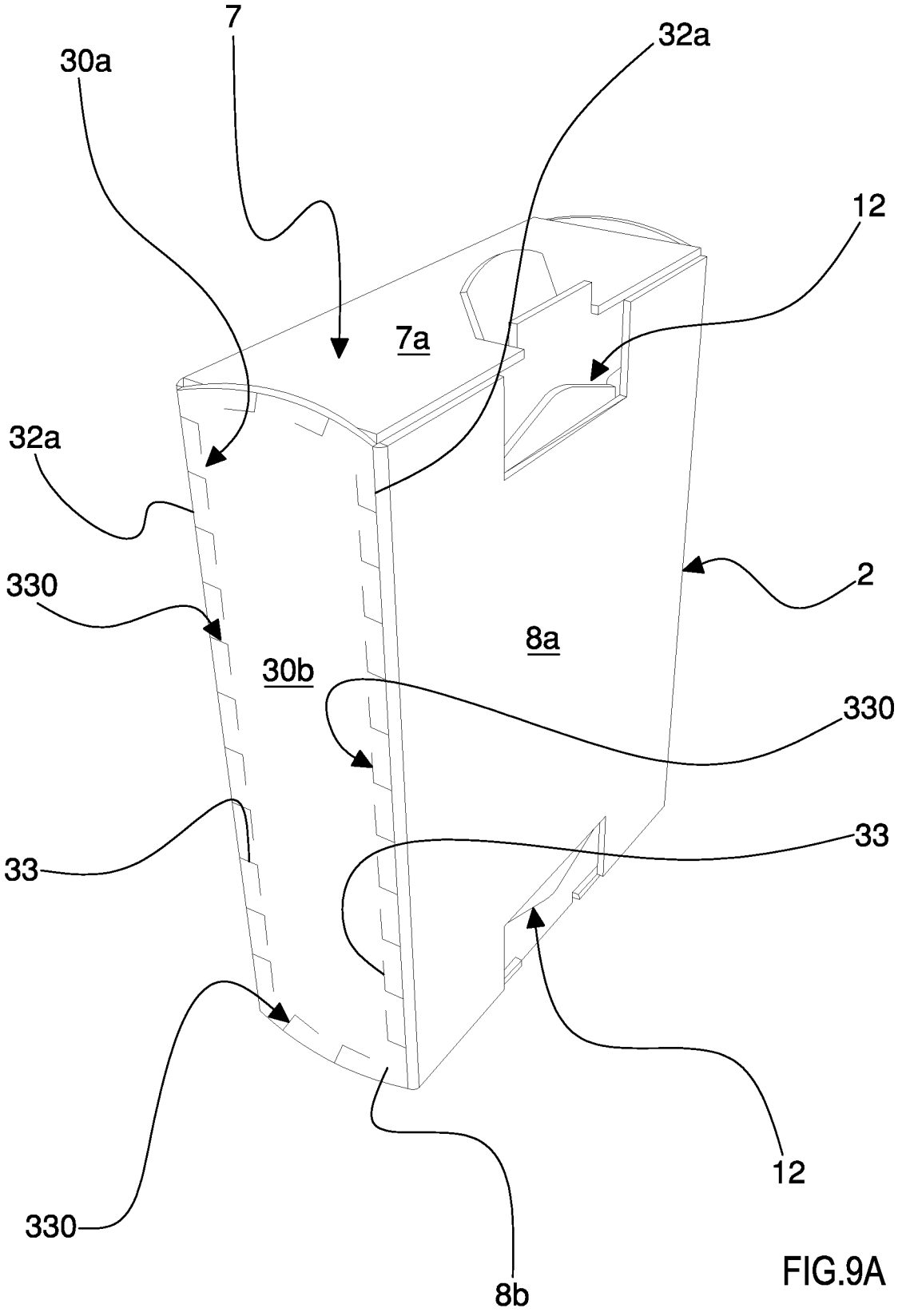

Figures from 4 to 7 are perspective views of respective variants of the container of FIG. 3;

FIG. 7A is a perspective view of a cross section of the closure system of FIG. 7 along the VIIA-VIIA track;

FIG. 8 is a blank for making a variant of a container according to the present invention;

FIG. 8A is a perspective view of a container made by means of the blank of FIG. 8;

FIG. 9 is a blank for making a further variant of a container according to the present invention;

FIG. 9A is a perspective view of the container made by means of the blank of FIG. 9.

DEFINITIONS AND CONVENTIONS

It should be noted that in the present detailed description corresponding parts illustrated in the various figures are shown with the same numerical references. The figures may illustrate the subject matter of the invention by means of representations that are not to scale; therefore, parts and components illustrated in the figures related to the subject matter of the invention may relate only to schematic representations.

The term "product" means an article or a compound of articles of any nature. For example, product may be in a solid state, liquid or gel form, or in the form of two or more of the aforementioned states of aggregation. Product may also be understood as a package, such as a blister pack, carrying a plurality of articles. The product may include: drugs, cosmetic products, dishwasher and washing machine capsules, household cleaning and laundry products (e.g., detergents), food, and cigarettes.

The term "paper material" means paper or paperboard, for example having at least 50 percent by weight, optionally at least 70 percent by weight, of organic material including one or more of cellulose, hemicellulose, lignin, lignin derivatives. The paper material can be made of sheet material having a weight comprised between 100 g/m$^2$ and 500 g/m$^2$. The paper material in question extends between a first surface and a second surface. The paper sheet material used for making the container may, in one embodiment, be covered for at least part of the first and/or second surface by a plastic material coating, for example biodegradable. If the coating covers at least part of the first surface, the same coating should define an inner surface of the container. Vice versa, if the coating is arranged on the second surface, the same coating should define an outer surface of the container. The coating can also be used to define a kind of water and/or moisture barrier useful to prevent weakening and loss of structure of the substrate resulting in uncontrolled deformation of the paper material constituting the latter component. The coating may be applied to the paper material (as specified above on the inner and/or outer side of the substrate) in the form of a so-called "coating" or lacquer laid down by solution or sprayed, having thickness generally comprised in a non-limiting way, between 0.2 μm and 10 μm. Alternatively, the coating may comprise a plastic film, such as a polycoating, applicable by a lamination process, on one or both sides (inner and/or outer side) of the paper material defining the container. If the coating is applied by lamination, the values of the plastic film (coating) may, for example, vary between comprised 10 μm and 400 μm, in particular comprised between 10 μm and 200 μm, even more in particular comprised between 10 μm and 80 μm, of coating material (i.e., polythene). The plastic coating material can be chosen, by way of example, from the following materials: PP, PE (HDPE, LDPE, MDPE, LLDPE), EVA, polyesters (including PET and PETg), PVdC.

The term "blank" refers to a flat semi-finished product made of sheet material, such as paper sheet material, that can be folded back on itself to make the container. The blank can be made in one piece and obtainable by die-cutting a single sheet.

The expression "bent configuration of the blank" refers to a configuration wherein the blank has been bent to form the container.

The term "sheet material" means a material that has two dimensions, such as length and width, that are significantly greater than a third dimension such as thickness.

The term "panel" means a laminar body of monolithic type having a substantially constant thickness which may be in mono-layer or multi-layer. The panel may develop flat or at least partly follow an undulating profile.

The term "opening device" means any tool that can be used by a user to open the container. For example, the opening device may comprise at least one selected in the group of: a body made of sheet material (e.g., a payment card, loyalty card, or a special key), an elongated body (e.g., a pen or a special key).

The term "manual intervention" means a manual action performed by the user without the use of tools, such as an opening device. Manual action is thus understood to mean the intervention of the user through his or her own hands directly on the container.

DETAILED DESCRIPTION

Container 1

With reference number 1 has been identified a container that can be used in the packaging industry for a variety of products such as: pharmaceuticals, cosmetics, cleaning products (laundry and dishwashing detergents), food, and tobacco products (cigars and cigarettes).

As shown in FIGS. 3-7, the container 1 includes storage 2 made of sheet material, such as paper material, defining a compartment 3 for housing products. The storage 2 has at least one side wall defining at least one passage opening delimited by a free edge 6. The storage 2 may have a substantially prismatic shape, for example having a rectangular profile, while not excluding the possibility of making a storage 2 having a different shape, for example having a square, trapezium or cylindrical cross-section.

The storage 2 may include a front wall 4*a* and a rear wall 4*b* facing and parallel to each other: the front wall 4*a* and the rear wall 4*b* are connected to each other by means of a first and a second side wall 4*c*, 4*d*, also facing and parallel to each other. The front wall 4*a* is spaced and opposed by the rear wall 4*b*; the first and second side walls 4*c*, 4*d* are also spaced and opposed to each other. The front, rear and side walls (4*a*, 4*b*, 4*c*, 4*d*) define the passage opening delimited by free edge 6.

The storage 2 also includes a bottom wall 4*f* from which the front wall 4*a*, rear wall 4*b*, and the first and second side walls 4*c*, 4*d* emerge from a perimeter edge delimiting the bottom wall 4*f*. The storage 2 may thus comprise a single passage opening opposed to the bottom wall 4*f*. In detail, the front wall 4*a*, the rear wall 4*b*, the first side wall 4*c*, and the second side wall 4*d*, in cooperation with the bottom wall 4*f*, delimit the compartment 3. Each of said walls (4*a*-4*d*, 4*f*) may have a substantially square or rectangular or trapezium shape.

The at least one side wall of the storage 2, optionally the front wall 4*a*, the rear wall 4*b*, the first side wall 4*c* and the second side wall 4*d*, emerge from the bottom wall 4*f*, optionally from an outer perimeter edge of the bottom wall 4*f*, for a predetermined extension: this extension substantially defines the height of the storage 2 which may be greater than 30 mm, optionally greater than 50 mm, even more optionally greater than 60 mm. The compartment 3 may have a volume greater than 40 $cm^3$, optionally greater than 100 $cm^3$ depending on the products to be contained. For example, if the container 1 is used to contain medium-sized products, the compartment 3 may have a volume comprised between 800 and 1,400 $cm^3$. For large products, the volume of the compartment 3 may reach 10,000 $cm^3$.

Alternatively, as shown in FIG. 9A, the storage 2 may include only the at least one side wall (e.g., walls 4*a*-4*d*) and being devoid of a bottom wall; in such a configuration, the storage 2 essentially defines a tubular element having two opposite passage openings.

One or more side walls of the storage 2 may include at least a single panel or flat sheet emerging from the bottom wall 4*f* and delimiting at least part of the compartment 3. In particular, each side wall may consist of a single panel, namely, a single sheet made of paper material. In detail, the storage 2 may be substantially identical to the package container as described in PCT Patent Application No. WO 2021/044266 A1 as published from page 14, line 26, to page 15, line 7. Alternatively, at least one side wall of the storage 2 may include at least one first panel 41 and at least one second panel 42 facing and stably engaged with each other. In detail, the storage 2 may be substantially identical to storage of the container as described in the Italian Patent Application No. 102021000025892 from page 16, line 13, to page 17, line 24.

The storage 2 may be made by a known process of folding and gluing a flat blank made of sheet material, such as paper; this process involves the provision of a side wall wherein an overlap zone is defined, glued and/or adhesively bonded, which allows the storage 2 to stably keep a three-dimensional shape, for example wherein the side wall (e.g., walls 4*a*-4*d*) emerges from the bottom wall.

As mentioned above, the storage 2 is made of sheet material which can include at least a first constraining portion 31 and a second constraining portion 32 overlapping to define an overlap zone having a peripheral zone 30*a* surrounding a central zone 30*b*; the first and second constraining portions 31, 32 are engaged to each other for at least part of the peripheral zone 30*a* by means of:

one or more portions of glue, optionally cold glue, one or more portions of adhesive material, optionally strips of adhesive material.

It is not excluded that one or more portions of glue and/or adhesive material are used to engage said first and second constraining portions also at the central zone 30*b* of the overlap zone. In fact, the storage 2 may be made by using a sheet material at least partially wrapped and/or folded for defining said overlapping portion comprising the first and second constraining portions glued and/or adhered to each other.

FIG. 9A illustrates, in a non-limiting way, a storage 2 having a first side wall 4*c* having said overlap zone. It is not excluded the possibility of arranging the overlap zone for the first and second side walls 4*c*, 4*d*. In the embodiments shown in the accompanying figures, the front wall 4*a* and rear wall 4*b* of the storage 2 are devoid of said overlap zone.

The container 1 includes a closure system 7 made of sheet material, optionally paper, configured to essentially define a closure element of the storage 2. In detail, the closure system 7 is movable with respect to the storage 2 at least between:

a closed condition where the closure system 7 prevents communication between the compartment 3 of the storage 2 and the external environment, an open condition where the closure system 7 allows communication between the compartment 3 and the external environment (FIG. 7).

In the embodiment shown in FIG. 8, closure system 7 and storage 2 are, in a non-limiting way, elements that are distinct from each other and completely separable. In particular, closure system 7 and storage 2 are relatively mobile with respect to each other at least between:

the closure condition in which closure system 7 occludes the passage opening of storage 2, and the open condition in which closure system 7 is separated from storage and allows communication between compartment 3 and the external environment.

The closure system 7 includes a predetermined number of side walls defining at least one access delimited by a free edge 7*b* configured for allowing the passage of the storage 2. The prefixed number of side walls of the closure system 7 emerges from a top wall 7*a* which delimits, in cooperation with said side walls, an inner volume 7*f* configured for receiving at least part of the storage 2; in fact, the access is configured for placing the inner volume 7*f* in communication with the external environment, as well as allowing insertion and removal of the storage 2 into/from the inner volume 7*f*. The relative movement between the closure system 7 and the storage 2 may be achieved by moving both parts, i.e., both the closure system 7 and the storage 2, or it can be achieved moving only one of the parts.

The storage 2, in the closed condition, is arranged in the inner volume 7*f*: the closure system 7, in this condition, prevents the insertion and the withdrawal of products from the storage 2. In the open condition, the closure system 7 is completely separated (spaced) from the storage 2 as visible, for example, in FIG. 7. During the transition from the closed condition to the open condition, and vice versa, the storage 2 and the closure system 7 slide with respect to each other as they approach or move away from each other: during such relative movement, the storage 2 is placed at least partially within the closure system 7 and displaces relatively (by movement of at least one of said storage and closure system) so that the bottom wall 4*f* of the storage 2 and the top wall 7*a* of the closure system 7 approach or move away from each other.

The closure system 7 has a structure at least partially countershaped to the storage 2 such that, in the closed condition, the closure system 7 fits externally to the storage 2. In detail, the closure system 7 comprises a front wall 8*a* and a rear wall 8*b* opposed to each other and connected by a first and second side walls 8*c* and 8*d*, which are also spaced apart and opposed to each other. In detail, the closure system 7 also has a rectangular prismatic shape: the front wall 8*a* and the rear wall 8*b* (having square or rectangular profile) are facing and parallel to each other and connected by means of the first and second side walls 8*c*, 8*d* (having square or rectangular profile) also facing and parallel to each other. In the closed condition:

the respective front walls 4*a*, 8*a* of the storage 2 and the closure system 7 are directly facing each other, the respective rear walls 4*b*, 8*b* of the storage 2 and the closure system 7 are directly facing each other, the respective first side walls 4*c*, 8*c* of the storage 2 and the closure system 7 are directly facing each other, the respective second side walls 4*d*, 8*d* of the storage 2 and the closure system 7 are directly facing each other.

However, it is not excluded the possibility of making a closure system 7 having a different shape, for example having a trapezium cross-section.

As mentioned above, the closure system 7 includes the top wall 7*a* from which emerge, from a perimeter edge of the top wall 7*a*, the front wall 8*a*, the rear wall 8*b*, and the first and second side walls 8*c*, 8*d*. Thus, the closure system 7 comprises a single access defined as opposed to the top wall 7*a* and delimited by the free edge 7*b*.

As mentioned above, the closure system 7 is countershaped to the storage 2. The countershaped configuration of the storage 2 and the closure system 7 allows the side walls of the closure system 7 to slide (relatively) externally side-by-side with the side walls of storage 2 during the transition from the closed to the open condition, and vice versa. In order to allow such relative movement, the closure system 7 has a slightly larger size than the storage 2, sufficient to allow it to fit into inner volume 7*f* of the closure system 7.

In an alternative embodiment not shown in the accompanying figures, the closure system 7 may be engaged to the free edge 6 of the storage and movable by rotation relative to the latter between the open and the closed conditions, and vice versa. Also in the latter embodiment, the closure system 7 includes a prefixed number of side walls defining at least one access delimited by a free edge 7*b* configured for allowing the insertion of the storage 2. The prefixed number of side walls of the closure system 7 may be defined by a front wall 8*a* that connects a first and a second side wall 8*c*, 8*d* facing each other; the prefixed number of side walls emerges from a top wall 7*a* which delimits, in cooperation with said side walls, the inner volume of the closure system 7 configured for receiving at least part of the storage 2. The closure system can then be hinged to a section of the free edge 6 of the storage 2 by means of the top wall 7*a*; the relative rotation between the closure system 7 and the storage 2 may be achieved by moving (in particular rotating) both parts, i.e., both the closure system 7 and the storage 2, or it can be achieved moving only one of the parts.

The at least one side wall of the closure system 7, optionally the front wall 8*a*, the rear wall 8*b*, the first side wall 8*c*, and the second side wall 8*d*, emerge from the top wall 7*a*, optionally from an outer perimeter edge of the top wall, by a predetermined extension: this extension substantially defines the height of the closure system 7 which may be greater than 30 mm, optionally greater than 50 mm, even more optionally greater than 60 mm. In detail, the height of the closure system 7 is substantially the same as the height of the storage 2 such that, in the closed condition, the storage is substantially entirely housed in the closure system, namely entirely arranged in the inner volume of the closure system. In particular, in the closed condition, the free edge 6 of the storage 2 is placed close to, optionally in contact with, the top wall 7*a* of the closure system 7 while the free edge 7*b* of the closure system 7 is placed close to, optionally around, the bottom wall 4*f* of the storage 2. The inner volume 7*f* of the closure system may be greater than 40 $cm^3$, optionally greater than 100 $cm^3$ depending on the size of the storage.

One or more side walls of the closure system 7 may comprise at least a single panel or flat sheet. In particular, each side wall of the closure system 7 may comprise a single panel, i.e., a single sheet of paper material. In detail, the closure system 7 may be substantially identical to the package container as described in PCT Patent Application No. WO 2021/044266 A1 as published from page 15, line 8, to page 16, line 17. Alternatively, at least one side wall of the closure system 7 may include at least one first panel 41 and at least one second panel 42 facing and stably engaged to each other; in detail, the closure system 7 may be substantially identical to the closure system of the container as described in Italian Patent Application No. 102021000025892 from page 16, line 27, to page 19, line 22.

The closure system 7 can be made by a known folding and gluing process of a flat blank made of sheet material, such as paper; this process involves arranging a side wall having an overlap zone, glued and/or adhesively bonded, which allows the closure system to stably maintain a three-dimensional shape, for example wherein the side wall (e.g., the walls 8*a*-8*d*) emerges from the top wall.

The closure system 7 can also be made of sheet material which can include at least a first constraining portion 31 and a second constraining portion 32 overlapped to each other to define an overlap zone having a peripheral zone 30*a* surrounding a central zone 30*b*; the first and second constraining portions 31, 32 are engaged to each other for at least part of the peripheral zone 30*a* by means of:

one or more portions of glue, optionally cold glue, one or more portions of adhesive material, optionally strips of adhesive material.

In detail, the glue portions and/or the adhesive material portions are arranged to overlap one or more subsequently detailed notches 33 defined on the peripheral zone 30*a* of the overlap zone of the closure system 7. It is not excluded the possibility of employing one or more glue and/or adhesive material portions to engage said first and second constraining portions also at the central zone 30*b* of the overlap zone.

In fact, the closure system 7 can be made by means of a sheet material at least partially wrapped and/or folded to define said overlapping portion comprising the first and second constraining portions glued and/or adhered to each other.

FIG. 7A shows a closure system having the overlap zone defined on the second side wall 8*d*. It is not excluded the possibility of arranging the overlap zone on both the first and second side walls 8*c*, 8*d* of the closure system 7. In the embodiments shown in the accompanying figures, the front wall 8*a* and the rear wall 8*b* of the closure system 7 are devoid of said overlap zone.

At least one side wall of the closure system 7 may also include a lowered section 7*c* defining a through opening configured for allowing the user, in the closed condition, to contact the side wall of the storage 2. The lowered section 7*c* is located at the free edge 7*b* of the closure system 7, in particular said lowered section 7*c* defines a kind of lowered profile continuous with the free edge 7*b* of the closure system 7. The lowered section 7*c* has an open profile, for example having semicircle shape, continuous with the free edge 7*b*. The lowered section 7*c* may be defined on each side wall of the closure system 7. A closure system 7 having a lowered section 7*c* defined on the front wall 8*a* and on the rear wall 8*b* has been shown in the accompanying figures.

The closure system 7 may also be made by processes of folding and gluing blank made of flat sheet material, optionally paper, or it may use a slit/inserting portion system as described above for storage.

As mentioned above, the first and second constraining portions 31, 32 are at least partially overlapping to define the overlap zone; the second constraining portion 32 delimits at least part of an outer surface of the container 1 and, for at least a portion of the peripheral zone 30*a*, has at least a plurality of notches 33 suitable for defining at least one breaking portion, separable from the central zone 30*b*. The notches 33 may pass through the thickness of the second constraining portion or may pass through only a portion of the thickness of the second constraining portion 32. In detail, the plurality of notches 33 defines a plurality of breaking portions arranged at least along a section of the peripheral zone 30*a* of the overlap zone. As shown, for example, in FIGS. 3-7, the second constraining portion 32 is delimited by a perimeter edge 32*a*: at least part of the plurality of notches 33 (optionally all the notches 33) extends for at least a section from the perimeter edge 32*a* towards the central zone 30*b*. In fact, at least part of the notches of the plurality of notches 33 is joined in one piece to the perimeter edge 32*a* of the second constraining portion 32.

It should be noted that each notch is solely defined within the peripheral zone of the overlap zone of the closure system, while the central zone 30*b* of the overlap zone is devoid of notches 33. In particular, the central zone 30*b* is defined by a smooth layer of paper sheet material, perimeterally delimited by the peripheral zone 30*a* of the overlap zone. The notches are then defined in an area of the peripheral zone 30*a* having a surface footprint smaller than a surface footprint of an area where the central zone 30*b* of the overlap zone of the closure system is defined. In particular, the ratio between the surface footprint area of the peripheral zone 30*a* and the surface footprint area of the central zone 30*b* is comprised between 0.1 and 0.5, optionally comprised between 0.1 and 0.25.

At least part of the notches, optionally all the notches, are aligned along the same, optionally curvilinear, trajectory having concavity facing the perimeter edge 32*a* of the second constraining portion 32. The notches of the plurality of notches 33 are distinct and spaced apart from each other, e.g. having a dashed-line shape (FIG. 7) or having a "U," "C," or "L" shape (FIGS. 3, 6, 7), evenly distributed in the peripheral zone 30*a* of the overlap zone and equidistant from each other. The notches 33 may be in number comprised between 3 and 50, optionally comprised between 5 and 30.

The perimeter edge 32*a* has a predetermined extension; the plurality of notches 33 extend over a preponderant part of the extension of the perimeter edge 32*a*; in particular, the plurality of notches 33 extend over at least 50%, optionally at least 70%, of the extension of the perimeter edge 32*a* of the second constraining portion 32. In other words, the notches of said plurality are defined over a preponderant part of the peripheral zone 30*a* of the overlap zone; in particular, the plurality of notches is defined over at least 50%, optionally at least 70%, of the extension of the peripheral zone 30*a* of the overlap zone.

The plurality of notches 33 includes at least one series of notches 330 having in turn a plurality of notches aligned along a trajectory T1. As shown in the accompanying figures, the trajectory T1 of the series of notches 330 may have curvilinear or having a continuous broken-line shape, with concavity facing the central zone 30*b* of the second constraining portion 32. In particular, the trajectory T1 may have a "U", "C", "L" or "V" shape, defined for a preponderant part of the perimeter edge 32*a* or for the entire extension of the same perimeter edge 32*a*.

The plurality of notches of the series of notches 330 defines, on the second constraining portion 32, a plurality of breaking portions arranged at least along a section of the peripheral zone 30*a* of the overlap zone. At least part of the plurality of notches of the series of notches 330 extends for at least a section from the perimeter edge 32*a* towards the central zone 30*b*. In fact, the notches of the series of notches 330 extend from the perimeter edge 32*a* of the second constraining portion 32; at least part of the notches of the series of notches 330 is joined in one piece to the perimeter edge 32*a* of the second constraining portion 32. At least part of the notches, optionally all of the notches, of said series of notches 330 has a shape having concavity facing the perimeter edge 32*a* of the second constraining portion 32; in particular, the notches of said series have a substantially "U" or "C" or "L" shape.

The notches of the series of notches 330 extend over a preponderant part of the extension of the perimeter edge 32*a*, for example, at least 50%, optionally at least 70%, of the extension of the perimeter edge 32*a* of the second constraining portion 32. In other words, the notches of the series of notches 330 is defined over a preponderant part of the peripheral zone 30*a* of the overlap zone, for example, such notches of the series of notches 330 is defined over at least 50%, optionally at least 70%, of the extension of the peripheral zone 30*a* of the overlap zone.

As, for example, shown in FIG. 7, the at least one series of notches 330 may have a first and a second series of notches 330', 330", each extending along respective trajectories T1, T2 entirely defined in the peripheral zone 30*a* of the overlap zone. In particular, the respective trajectories T1, T2 of the first and second series of notches 330', 330" are spaced apart and, for at least a stretch, parallel to each other; the second series of notches 330" extends to the side of the first series of notches 330' for at least part, optionally all, of the extension of the first series of notches 330' along the peripheral zone 30*a*. The first series of notches 330' thus results interposed between the perimeter edge 32*a* and the second series of notches 330".

The respective trajectories of the first and second series may extend over a preponderant part of the extension of the perimeter edge 32*a* or over the entire extension of the perimeter edge: in this second alternative, the trajectories of the first and second series are concentric to each other proceeding from the perimeter edge 32*a* toward the central 30*b* zone of the overlap zone of the closure system 7.

It should be noted that the notches of the first series of notches 330' may have a different shape than the notches of the second series of notches 330", e.g. in the embodiment shown in FIG. 7, the notches of the first series of notches 330' are shaped as a hook or "L" shape, while the notches 33 of the second series of notches 330" are discrete straight elements placed side by side to essentially define a dotted line.

Figure 4:
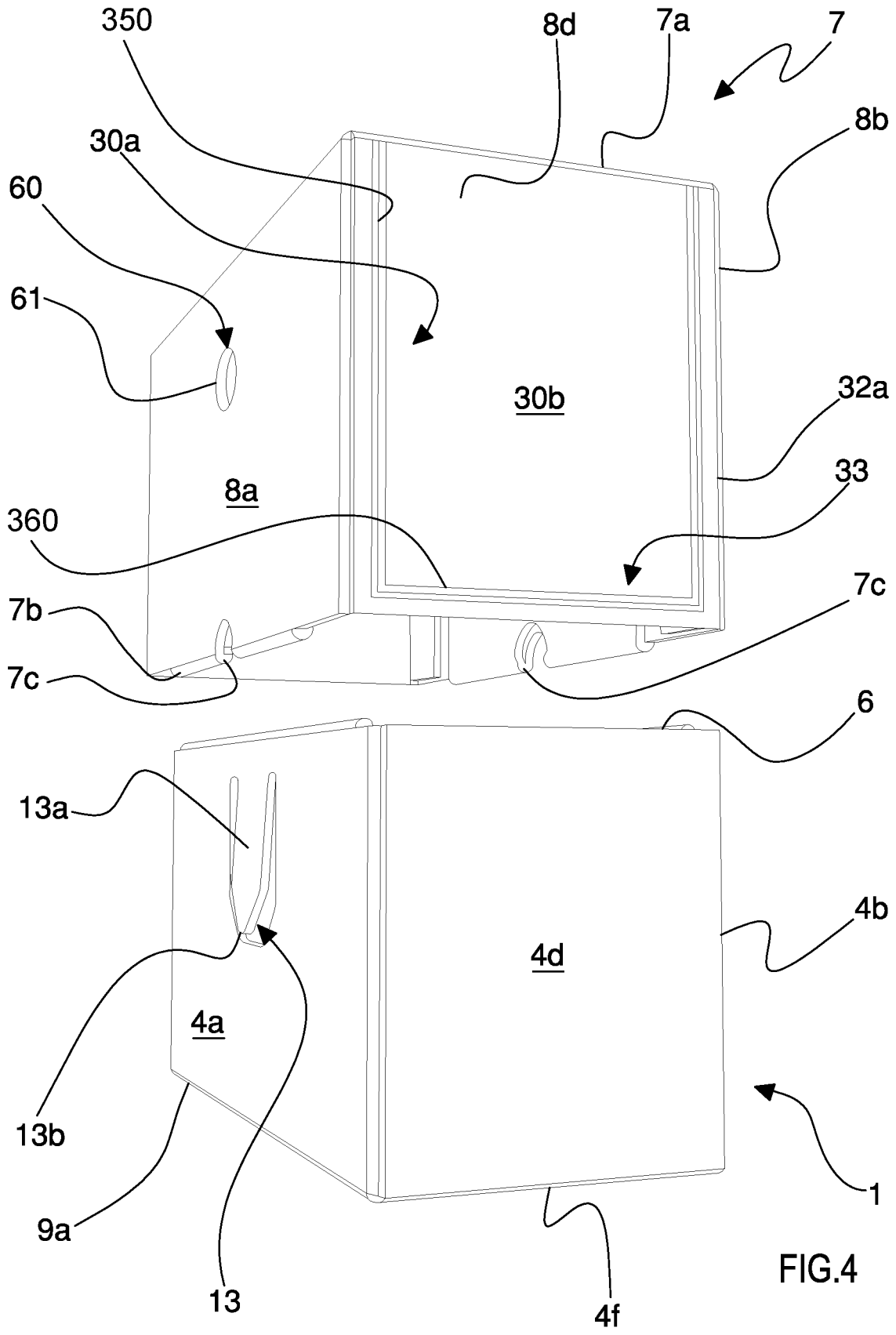
Figure 5:
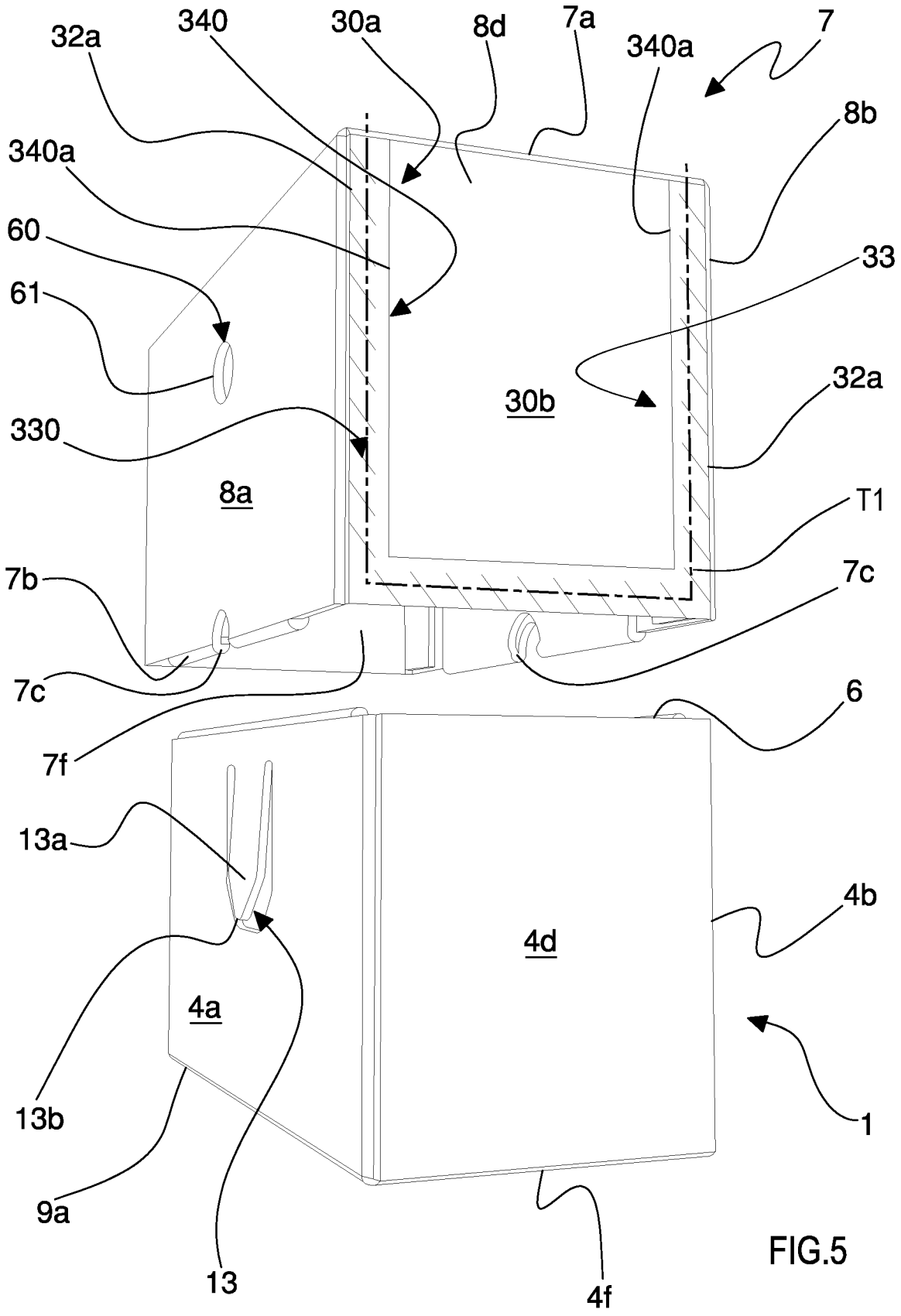
Figure 6:
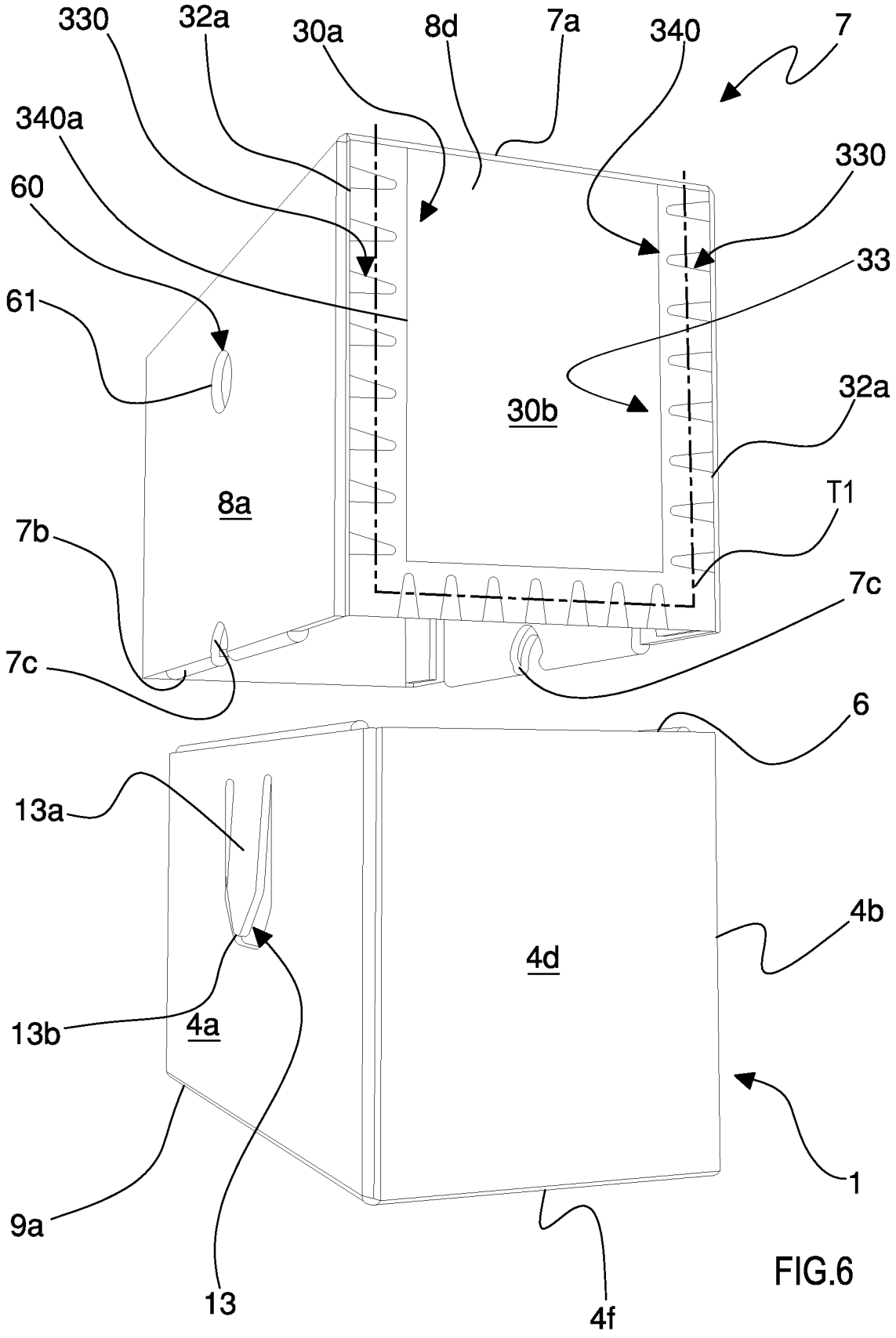

In further embodiments shown in FIGS. 4, 5 and 6, the plurality of notches 33 may have at least one auxiliary notch 340 disposed to the side of the series of notches 330, in interposition between said series of notches 330 and the central zone 30*b* of the overlap zone. The at least one auxiliary notch 340 extends to the side of the series of notches 330 for at least part, optionally all, of the extension of said series of notches 330 along the peripheral zone 30*a*. The at least one auxiliary notch 340 can be at least partially countershaped to the perimeter edge 32*a* of the second constraining portion 32 and surround at least part (optionally all) of the notches of the series of notches 330: in fact, the series of notches 330 and the at least one notch 340 are placed concentrically to each other. In fact, the at least one auxiliary notch 340 comprises a single continuous cut extending along a trajectory which, for at least a section, is parallel to the alignment trajectory T1 of the notches of the series of notches 330.

The trajectory of auxiliary notch 340 may be concentric to the trajectory T1 of the series of notches 330 and having a curvilinear or continuous broken-line shape, with concavity facing the central 30*b* zone of the overlap zone of the closure system. The trajectory of the auxiliary notch 340 can also have a "U", "C" or "V" shape.

The at least one auxiliary notch 340 may extend over a preponderant part of the extension of the perimeter edge 32*a*, for example, over at least 50%, optionally at least 70%, of the extension of the perimeter edge 32*a* of the second constraining portion 32. In other words, the at least one auxiliary notch 340 is defined on a preponderant part of the peripheral zone 30*a* of the overlap zone, for example, on at least 50%, optionally at least 70%, of the extension of the peripheral zone 30*a* of the overlap zone.

The at least one auxiliary notch 340 may include one continuous notch (see FIGS. 5 and 6) or it may comprise:

a. at least a first auxiliary 340*a* notch arranged alongside of the series of notches 330, b. at least a second auxiliary notch 340*b* placed alongside the first auxiliary notch 340*a* so that the latter is interposed between the series of notches 330 and the second auxiliary notch 340*b*.

The first and second auxiliary notches 340*a*, 340*b* are side by side with each other and placed substantially concentrically. The first and second auxiliary notches 340*a*, 340*b* are essentially identical to each other in shape and extend along respective trajectories parallel to each other. In a further variation shown in FIG. 4, the plurality of notches 33 includes:

a. at least one continuous first notch 350 defined on the peripheral zone 30*a* of the overlap zone, which is spaced from the perimeter edge 32*a* of the second constraining portion 32, b. at least a second continuous notch 360 defined on the peripheral zone 30*a* of the overlap zone which is spaced from the perimeter edge 32*a* of the second constraining portion 32.

The second notch 360 is placed to the side of the first notch 350 such that said first notch 350 is at least partially interposed between said second notch 360 and the free edge 32*a* of the second constraining portion 32. In particular, the first and second notches 350, 360 are placed concentrically to each other.

The first and second notches 350, 360 are side by side, concentrically arranged with each other proceeding from the perimeter edge 32*a* toward the central zone of the overlap zone. The first and second notches 350, 360 are single continuous cuts conformed to "U," "C," or "V," substantially identical to each other in shape and extending along respective trajectories parallel to each other, having concavities facing toward the central zone 30*b* of the overlap zone. The first and second notches 350, 360 extend for a preponderant part of the extension of the perimeter edge 32*a*, for at least 50%, optionally for at least 70%, of the extension of the perimeter edge 32*a* of the second constraining portion 32.

FIGS. 5 and 6 show a second constraining portion 32 comprising the plurality of notches 33 including both the series of notches 330 and the at least one auxiliary notch 340. FIG. 3 shows a plurality of notches comprising only a series of notches 330: there is no auxiliary notch 340 in the form of a continuous line placed concentrically to the series 330.

As specified above, the overlap zone comprises the plurality of notches 33 that can be defined on the storage 2 and/or on the closure system 7. In greater detail, in the embodiment of the container 1 shown for example in FIG. 2, namely wherein closure system 7 includes at least the walls 8*a*-8*c*, optionally the walls 8*a*-8*d*, and is configured to house at least part of the storage 2, the overlap zone may be solely defined by one or more side walls of the closure system 7 (e.g., by the first and/or second side walls 8*c*, 8*d*). As mentioned above, the first side wall 8*c* of the closure system 7 may have a square or rectangular shape; therefore, the plurality of notches 33 may be defined in correspondence of at least 2, optionally at least 3 sides of the first side wall 8*c* of the closure system 7. The plurality of notches 33 may be defined at the side of the first side wall 8*c* of the closure system 7 directly engaged to the top wall 7*a* of the closure system 7 and in correspondence of at least one, optionally both, sides immediately adjacent to the side directly engaged to the top wall 7*a* and opposed to each other.

The second side wall 8*d* of the closure system 7 may have a square or rectangular shape; the plurality of notches 33 may be defined in correspondence of at least 2, optionally at least 3 sides of the second side wall 8*d* of the closure system 7. The plurality of notches 33 may be defined at the side of the second side wall 8*d* of the closure system 7 directly engaged to the top wall 7*a* and in correspondence of at least one, optionally both, sides immediately adjacent to side directly engaged to the top wall 7*a* and opposed to each other.

In the configuration where the closure system 7 is configured for housing only part of the storage 2 (thus leaving the at least one side wall of the storage exposed in the closed condition), the overlap zone can be defined either on the closure system 7 (e.g., on at least one of the first and second side walls 8*c*, 8*d*) or on at least one side wall of the storage, e.g., on at least one of the first and second side walls 4*c*, 4*d*. In the configuration where the closure system 7 is configured to be inserted at least partially into the storage 2 to define the closed condition of the container (FIG. 9A), the overlap zone can only be defined on at least one side wall of the storage 2, e.g., on at least one of the first and second side walls 4*c*, 4*d*.

As mentioned above, the first side wall 4*c* has a square or rectangular shape; if present, the plurality of notches 33 may then be defined in correspondence of at least 2, optionally at least 3 sides of the first side wall 4*c*. For example, the plurality of notches 33 is defined at the side of the first side wall 4*c* directly engaged to the bottom wall 4*f* and in correspondence of at least one, optionally both, sides immediately adjacent to side directly engaged to the bottom wall 4*f* and opposed to each other. The second side wall 4*d* may also have a square or rectangular shape; if present on said wall, the plurality of notches 33 may be defined in correspondence of at least 2, optionally at least 3 sides of the second side wall 4*d*. The plurality of notches 33 may be defined at the side of the second side wall 4*d* directly engaged to the bottom wall 4*f* and in correspondence of at least one, optionally both, sides immediately adjacent to side directly engaged to the bottom wall 4*f* and opposed to each other.

The container 1 includes at least one first coupling portion 12 carried by the closure system 7 and at least one second coupling portion 13 carried by the storage 2, configured to cooperate with the first coupling portion 12; the first and second coupling portions 12, 13 are configured to engage with each other in the closed condition of the storage 2 and the closure system 7 to define a locking condition wherein said first and second coupling portions 12, 13 prevent the closure system 7 and the storage from switching from the closed condition to the open condition. For example, the first coupling portion 12 can be carried by at least one side wall of the closure system 7. In particular, container 1 can include at least one of:

- a first coupling portion 12 carried by the front wall 8*a* of the closure system 7,
- a first coupling portion 12 carried by the rear wall 8*b* of the closure system 7,
- a first coupling portion 12 carried by the first side wall 8*c* of the closure system 7,
- a first coupling portion 12 carried by the second side wall 8*d* of the closure system 7.

A configuration of the container 1 has been shown in the accompanying figures wherein the first coupling portion 12 may be solely carried by the front wall 8*a* (FIG. 7A) of the closure system 7. It is not excluded the possibility of arranging one or more first coupling portions 12 on the same side wall and/or at least one first coupling portion 12 for each side wall of the closure system 7.

The first coupling portion 12 may be any coupling portion of a child-proof system. For example, the first coupling portion 12 can be identical to the first coupling portion of the container as described in:

- PCT Patent Application No. WO 2021/044266 A1 as published from page 16, line 22, to page 17, line 35, or
- PCT patent application No. WO 2021/044267 A1 as published from page 21, line 8, to page 22, line 13, or
- PCT patent application No. WO 2021/044268 A1 as published from page 20, line 9, to page 21, line 2, or
- Italian Patent Application No. 102021000025892 from page 19, line 30, to page 21, line 32.

As mentioned above, the container 1 includes at least one second coupling portion 13 configured to cooperate with one or more of the first coupling portions 12 to define the locking condition. In detail, the container 1 may include a second coupling portion 13 for each first coupling portion 12. The second coupling portion 13 is carried by at least one side wall of the storage 2 and emerges externally to the compartment 3 of the storage 2, distinct and spaced from the free edge 6 of the latter. In fact, the first and second coupling portions, in the locking condition, are engaged externally to the compartment 3 of the storage 2 and internally to the inner volume 7*f* of the closure system 7.

The second coupling portion 13 includes at least one tab 13*a* projecting from the side wall of the storage to define an undercut delimited by at least one perimeter edge 13*b* located outside the compartment 3, distinct and spaced from the free edge 6 of the passage opening. The tab 13*a* may have a substantially rectangular or triangular profile or substantially having a trapezium shape or having substantially "V" or "C" shape: wherein the perimeter edge 13*b* has at least one section, optionally two straight sections, sloped with respect to the free edge 6 of the passage opening of the storage, optionally by an angle comprised between 20° and 80°, even more optionally by an angle comprised between 30° and 70°. In more detail, the perimeter edge 13*b* of tab 13*a* can have a substantially "V" or "C" shape, the concavity of which faces the free edge 6 of storage 2.

The tab 13*a* extends substantially along a plane and is directly facing the side wall of the storage 2 directly carrying said tab 13*a*; the tab 13*a* may be sloped with respect to the side wall of the storage 2 directly bearing said tab 13*a* by an angle lower than 40°, optionally by an angle comprised between 1° and 30°; the angle is measured between the surface of the tab 13*a* directly facing the side wall of the storage 2 and the same side wall directly carrying (directly joined in one piece) said tab 13*a*. The second coupling portion 13 may be directly joined in one piece to at least one of said side walls of the storage 2 by means of a folding edge to define a folded portion. In such configuration, the tab 13*a* is joined in one piece with a side wall and folded with respect to the side wall so that the tab 13*a* is at least partially overlapping and facing the side wall to which said tab 13*a* is directly connected (joined in one piece). Only part of the tab defines the undercut suitable for cooperating with the first coupling portion 12.

In fact, the second coupling portion 13 of the container 1 may be identical to the second coupling portion carried by the package container as described in PCT Patent Application No. WO 2021/044266 A1 as published from page 18, line 1, to page 20, line 15. Alternatively, the second coupling portion 13 may be identical to the second coupling portion carried by the storage as described in Italian Patent Application No. 102021000025892 from page 21, line 23, to page 24, line 8, which is suitable for cooperating with a spacer also described in Italian Patent Application No. 102021000025892 from page 24, line 9, to page 26, line 5.

The first and second coupling portions 12, 13 are disengageable, for example, by means of a release portion 60 configured to define at least one through access 61 on at least one side wall of the closure system at the first and second coupling portions 12, 13. The release portion 60 is configured to allow, at least in the locking condition, direct access from outside the container 1 to at least one of said first and second coupling portions 12, 13 to allow disengagement thereof. In further detail, the release portion 60 is configured to allow a user, at least in the locking condition, to act from outside the container directly on at least one of said first and second coupling portions 12, 13 manually and/or via an opening device insertable through opening access 61. In greater detail, the release portion 60 is configured to allow, at least in the locking condition, intervention from outside the container directly on the tab 13*a* of the second coupling portion 13.

The release portion 60 may comprise a through access 61 defined on at least one side wall of the closure system 7. Alternatively, the release portion 60 may comprise a deformable portion (not shown in the accompanying figures) placed, in the locking condition, in front of the first and second coupling portions 12, 13: in such configuration, the release portion 60 essentially comprises a thrust portion configured to be moved (either manually by the user or by an opening device) between a thrust condition and a rest condition. In the rest condition, the thrust portion is spaced apart from the second coupling portion 13, while in the thrust condition, the thrust portion operates on the second coupling portion 13 to allow it to be disengaged from the first coupling portion 12; in the latter configuration, the thrust portion of the release portion 60 may act as a thrust button. The thrust of a user's finger on the thrust portion according to a direction entering the container allows the thrust portion to contact the second coupling portion 13, disengaging it from the undercut of the first coupling portion 12. The thrust portion can be reversibly movable between the thrust and rest conditions. For this purpose, the thrust portion can be elastically deformable between the thrust condition and the rest condition.

Process for Making a Container 1

It is also an object of the present invention to provide a process for making a container 1 according to the above description and/or according to any of the appended claims. The process includes arranging the closure system 7, which may be made by means of a first flat blank 50 made of in sheet material, optionally paper, comprising:

a central sheet 51, a predetermined number of side sheets 52 joined in one piece to the central sheet 51 and emerging from the latter from a perimeter edge.

The central sheet 51 has a polygonal profile, optionally rectangular or square. From each side of central sheet 51 extends a side sheet 52 also having a polygonal profile, optionally rectangular or square.

Arranging closure system 7 includes the sub-step of folding the predetermined number of side sheets 52 to define the predetermined number of side walls of the same closure system 7. In detail, the side sheets are folded with respect to the central sheet 51 so as to define a three-dimensional configuration of the closure system itself. The side sheets 52 are constrained together such that the closure system 7 can maintain its three-dimensional shape, such as by the application of glue or an adhesive component.

The blank 50 may have at least one connecting sheet 55 joining in one piece two adjacent side sheets 52 (FIG. 2); in such configuration, the process involves overlapping and joining, e.g., by gluing, simultaneously to folding the side sheets 52, the connecting sheet 55 to adjacent folded side sheets, defining the overlap area. The closure system can thus maintain a three-dimensional structure with the side sheets 52 defining the side walls and the central sheet defining the top wall 7*a*.

Figure 2:
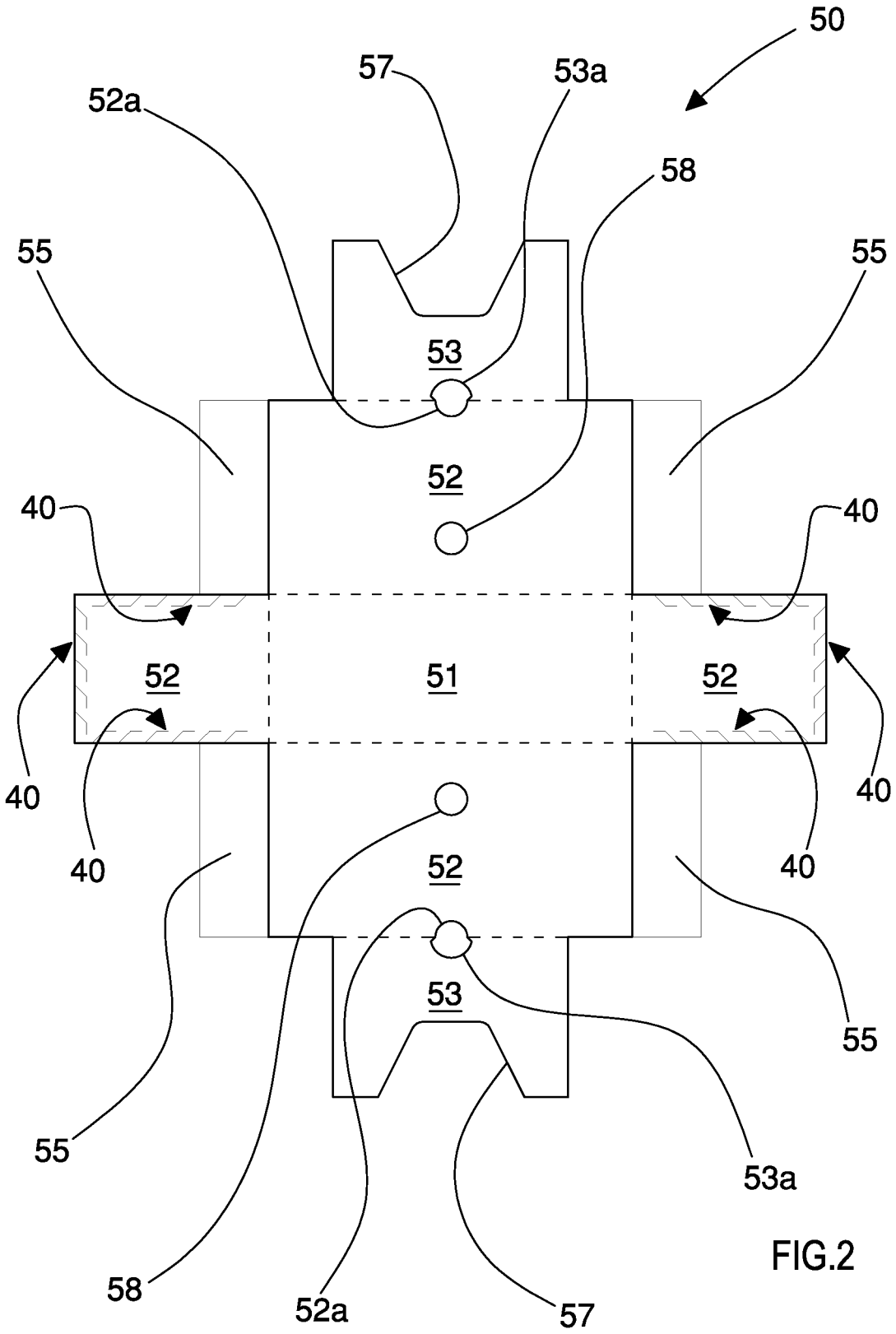
FIG. 2 is a blank for making a storage of a container according to the present invention.

As shown in FIG. 2, one or more side sheets 52 may include at least one passing-through notch 40, in particular a plurality of passing-through notches 40 made at a peripheral zone of the overlap zone. However, according to what has been previously described, it is not excluded to provide passing-through notches 40, in addition to the peripheral zone, also at a central zone of the overlap zone. Thus, the process may involve arranging one or more series of passing-through notches 40 substantially concentric to each other proceeding from the peripheral zone towards the central zone of the overlap zone.

The first blank may further comprise at least one peripheral sheet 53 engaged to at least one of said side sheets 52. The process may further comprise defining the at least one first coupling portion 12 by the at least one peripheral sheet 53. In detail, the peripheral sheet 53 emerges from a perimeter edge of the at least one side sheet 52 of the at least one first blank 50 itself on the opposite side of the central sheet 51. In the accompanying figures, a first blank 50 comprising two opposing peripheral sheets 53 has been shown non-limiting way. However, it is not excluded the possibility of providing one or more peripheral sheets joined in one piece and emerging from each side sheet 52. The first coupling portion 12 is made overlapping the peripheral sheet 53 of the first blank 50 above the side sheet 52 from which it emerges and engaging the peripheral sheet itself, for example by means of a portion of glue, to the same side sheet 52. The folding phase of the at least one peripheral sheet 53 may be performed prior to, simultaneously with, or subsequent to the folding and engaging of the side sheets 52 to each other. The step of defining the first coupling portion 12 includes performing a through notch 57 on the peripheral sheet 53 to define directly on said peripheral sheet the gripping edge 12*a* of the first coupling portion 12. The side sheet 52 thus defines a side wall of the closure system, while the peripheral sheet at least partially defines the coupling portion 12 placed substantially internally within the inner volume of the closure system.

As described above, the closure system 7 may also have the release portion 60 which may be made providing a notch 58 on at least one side sheet 52 of the first blank 50. The notch 58 passes through the side sheet 52 and is performed on a side sheet 52 directly joined in one piece to a peripheral sheet 53. The notch 58 may be either open profile or closed profile. The central sheet 51, the side sheets 52, the peripheral sheets 53 and the connecting sheets 55 of the first notch 50 can be joined in one piece to define a single notch, for example made of paper material. The closure system 7 can then be achieved by folding and gluing steps of a single blank (first blank 50). The first blank 50 may be obtained by one or more die-cutting steps of a single flat sheet or by one or more laser cutting steps. The passing-through notches 40 may also be made by a die-cutting or laser cutting process, for example, performed simultaneously as the die-cutting or laser cutting step of the first blank 50.

The process also includes arranging the storage 2 which may be made using a second flat blank 70 made of sheet material, which includes:

a central sheet 71, a predetermined number of side sheets 72 joined in one piece to the central sheet 71 and emerging from the latter from a perimeter edge.

Figure 1:
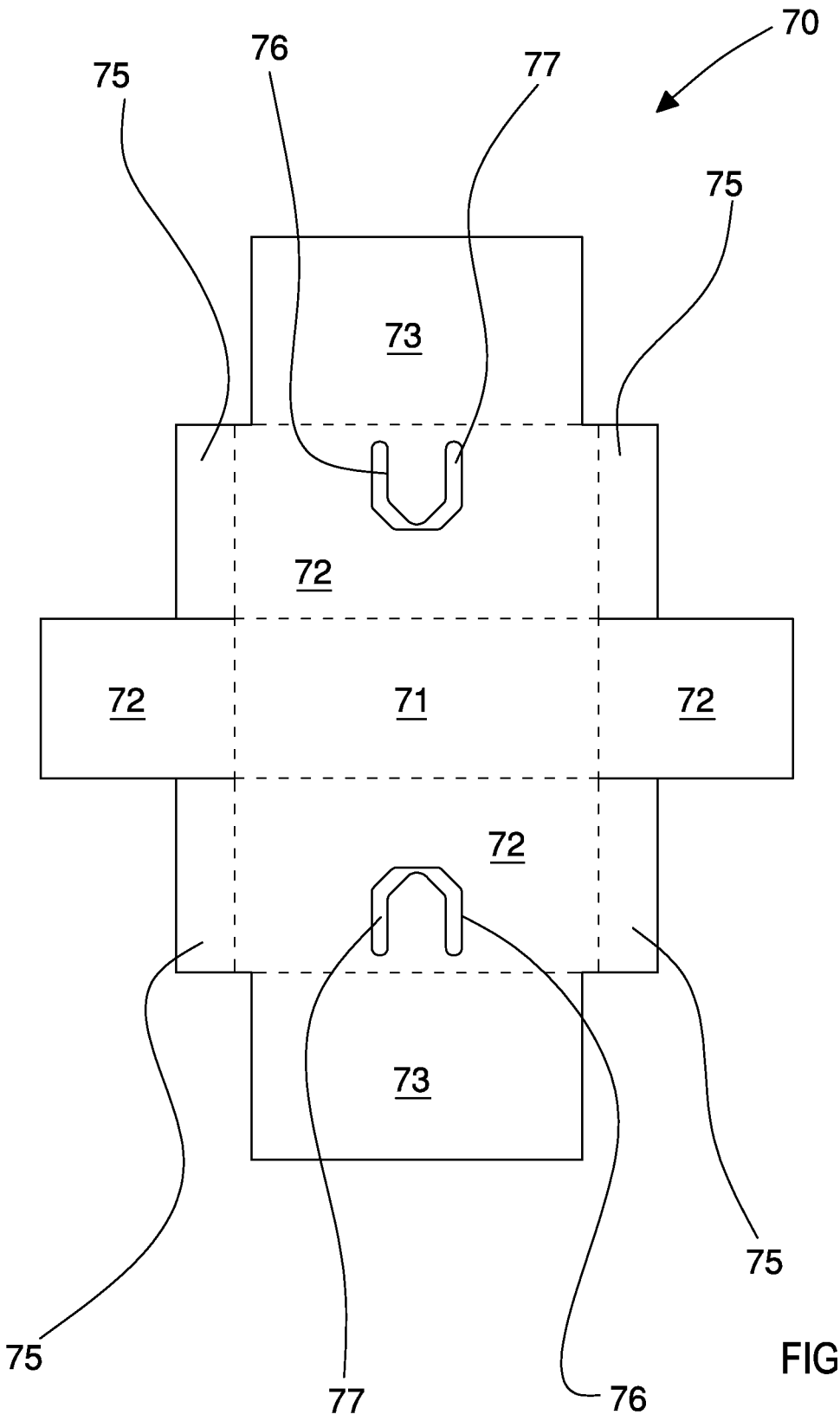
FIG. 1 is a blank for making a closure system of a container according to the present invention.

The central sheet 71 may have a polygonal profile, optionally rectangular or square. From each side of the central sheet 71 extends a side sheet 72 also having a polygonal profile, optionally rectangular or square. The process of making the container 1 also includes a sub-step of folding the predetermined number of side sheets 72 to define the predetermined number of side walls of the container 1. In detail, the side sheets 72 are folded with respect to the central sheet 71 such that a storage 2 having a three-dimensional shape may be obtained from the flat blank 70. The side sheets 72 are constrained to each other so that the storage 2 may maintain its three-dimensional shape; the side sheets 72 are constrained directly to each other by means of a connecting sheet 75 that joins in one piece two adjacent side sheets 72 (FIG. 1). In such configuration, the process involves overlapping and joining, e.g., by gluing the connecting sheet 75 to adjacent side sheets 72, allowing the container 1 to maintain its three-dimensional shape.

The process also includes making the at least one second coupling portion 13. Each second coupling portion 13 may be made providing a peripheral sheet 73 emerging from a perimeter edge of at least one side sheet 72, on opposite sides to the central sheet 71 of the second blank 70. The peripheral sheet 73 is folded overlapping the side sheet 72 of the same second blank 70 from which it emerges and constraining the peripheral sheet itself, for example by a portion of glue, to said side sheet 72. The folding of the at least one peripheral sheet 73 may be performed prior to, simultaneously with, or subsequent to folding and constraining of the side sheets 72. Alternatively, the second coupling portion 13 may be obtained by a step of cutting one of said side sheets 72 of the second blank 70 to define directly on said at least one side sheet a through notch 76 (FIG. 1) suitable for defining the tab 13*a* of the second coupling portion 13. The notch may be made so that there is a groove 77 around the tab 13*a* that separates the tab 13*a* from the peripheral sheet 73. The central sheet 71, the side sheets 72 and the peripheral sheet 73 of the second blank 70 are joined in one piece to define a single blank. The container 1 may then be made through folding and gluing steps of a single blank.

The second blank 70 may be made by one or more steps of die-cutting a single flat sheet or by one or more steps of laser cutting.

The first and second blank 50, 70, although obtainable by a die-cutting step of a single sheet, they may be made as separate and distinct pieces (which can be machined separately to obtain a closure system 7 separate from the container 1) or they can also be joined in one piece and made by a die-cutting step of a single flat sheet to make a container, for example by folding a single blank 80 shown in FIG. 8. In detail, the single blank 80 has essentially the same configuration as the second blank 70 in FIG. 1, which includes the central sheet 71 from which four side sheets 72 emerge according to the above description of the second blank 70. The single blank 80 also includes a central auxiliary sheet 51 and three auxiliary side sheets 52 according to the above description of the first blank 50. As visible from FIG. 8, the central sheet 71, the auxiliary central sheet 51 and the auxiliary side sheets 52 are joined in one piece and aligned along a single connecting direction, wherein the auxiliary central sheet 51 is interposed between a side sheet 72 and an auxiliary side sheet 52.

The auxiliary central sheet 51 has a polygonal profile, optionally rectangular or square. From each side of the central auxiliary sheet 51 extends an auxiliary side sheet 52 also having a polygonal profile, optionally rectangular or square.

The step of providing a closure system 7 includes the sub-step of folding the predetermined number of auxiliary side sheets 52, with respect to the central auxiliary sheet 51. The auxiliary side sheets 52 are engaged together by connecting sheets 55, such as by glue or any adhesive material.

The first coupling portion 12 is made by overlapping a peripheral sheet 53 above a respective auxiliary side sheet 52 from which it emerges and engaging it, for example by a portion of glue, to the same auxiliary side sheet 52. The folding of the peripheral sheet 53 may be performed before, simultaneously or after folding and engaging of the auxiliary side sheets 52 to each other.

The step of defining the first coupling portion 12 includes making a through notch 57 on the peripheral sheet 53 to define directly on said peripheral sheet the gripping edge 12*a* of the first coupling portion 12. The auxiliary side sheet 52 then defines a side wall of the closure system, while the peripheral sheet 53 at least partially defines the coupling portion 12 placed substantially internally the inner volume of the closure system 7.

The closure system 7 may also have the release portion 60 which may be made providing a notch 58 on at least one auxiliary side sheet 52. The notch 58 is passing-through the auxiliary side sheet 52 and is performed on an auxiliary side sheet 52 joined in one piece to a peripheral sheet 53. The notch 58 may be either have an open profile or closed profile.

The arrangement of the storage may involve a step of folding the predetermined number of side sheets 72 to define the predetermined number of side walls of the storage of the container. In detail, the side sheets 72 are folded with respect to the central sheet 71 so that a storage having a three-dimensional conformation may be obtained from the flat blank 70. The side sheets 72 are constrained to each other by means of a connecting sheet 75 that joins two adjacent side sheets 72 in one piece, defining the overlap zone. One or more of the side sheets 72 may comprise at least one passing-through notch 40, in particular a plurality of passing-through notches 40 made at a periphery zone of the overlap zone. However, according to what has been previously described, it is not excluded providing passing-through notches 40, in addition to the peripheral zone, also at a central zone of the overlap zone. Thus, the process may involve providing one or more series of passing-through notches 40 each other substantially concentric proceeding from the peripheral zone toward the central zone of the overlap zone.

The process also includes providing the at least one second coupling portion 13. Each second coupling portion 13 may be performed arranging a peripheral sheet 73 emerging from a perimeter edge of at least one of the side sheets 72, optionally emerging from a side sheet 72 on the opposite side of the central auxiliary sheet 51. The peripheral sheet 73 is overlapped to the side sheet 72 and constrained, for example by a portion of glue, to the same side sheet 72 from which it emerges. The folding of the at least one peripheral sheet 73 may be performed before, simultaneously, or after folding and constraining the side sheets 72.

Alternatively, the second coupling portion 13 may be made by a cutting step of one of said side sheets 72 to define directly on said side sheet at least one through notch 76 suitable for defining the tab 13*a* of the second coupling portion 13. The notch may be made so that a groove 77 is present around the tab 13*a*.

The container 1 may be made by folding and gluing steps of a single blank obtained by one or more die-cutting steps of a single flat sheet or by a laser cutting process of the single blank 80. The through-notches can also be achieved by a die-cutting or laser cutting process, for example, performed simultaneously as the die-cutting or laser cutting step of the single blank 80.

In a further embodiment shown in FIG. 9, the container may have a closure system that can be at least partially inserted within the storage of the container, which may be made by die-cutting, folding, and gluing steps of a single flat sheet defining the auxiliary blank 90.

In relation to this embodiment, the process may include providing the storage 2, which, as described above, is made of sheet material, optionally paper. This step involves providing at least one main sheet 91 comprising at least a first and a second portion 92, 94 interconnected by a central connecting portion 93. The main sheet 91 further comprises at least a first and a second side connecting portions 95, 96. The central connecting portion 93 is interposed between the first and second portions 92, 94, the first portion 92 is interposed between the first side connecting portion 95 and the central connecting portion 93, and the second portion 94 is interposed between the second side connecting portion 96 and the central connecting portion 93. Each of said portions 92, 93, 94, 95, 96 includes at least two opposing longitudinal edges and two opposing end edges: the portions 92, 94, the central connecting portion 93, and said side connecting portions 95, 96 are joined along the longitudinal edges and aligned along a single connecting direction.

In one configuration, the first portion 92 of the main sheet 91 may have a rectangular profile delimited at its perimeter by a bottom edge 92*a*, a first and second side edges 92*b*, 92*c* and a top edge 92*d*. Similarly, the second portion 94 of the main sheet 91 has a rectangular profile delimited at its perimeter by a bottom edge 94*a*, a first and second side edges 94*b*, 94*c* and an upper edge 94*d*. Advantageously, the first and second portions 92, 94 comprise a sheet having substantially the same shape and size. The central portion 93 and the side connecting portions 95, 96 also have rectangular profiles; these portions have substantially the same shape and/or size and are joined in one piece to the portions 92 and 94 of the first sheet at the side edges.

The second side connecting portion 96 includes at least one through notch 40, in particular a plurality of through notches 40 defined on the storage at an overlapping surface between the side connecting portions 95, 96, joined together, for example by glue, to maintain the storage in the folded three-dimensional shape. Such passing-through notches 40 may be made by a die-cutting or laser cutting process, e.g., performed during the step of providing the main sheet 91. The step of providing the storage 2 involves a step of folding the main sheet 91 at the side edges of the portions 92, 93, 94, 95, and 96 such that it is possible to join the side connecting portions 95, 96 of the main sheet 91 itself.

The process further involves providing the closure system 7 made by folding steps of the auxiliary central sheets 97 respectively joined in one piece to the top edge and the bottom edge 94*a*, 94*d* of the second portion 94. Each auxiliary central sheet 97 comprises at least a first and a second portion 98, 99 joined in one piece with each other: the first portion 98 is connected to the second portion 94 of the main sheet 91. In the accompanying figures different embodiments have been shown wherein two second auxiliary central sheets 97 engaged to the second portion 94 of the main sheet 91 at the lower edge 94*a* and at the upper edge 94*d*. The second portion 99 of a respective auxiliary central sheet has a tab 99*a* intended to form the first coupling portion 12.

Each second coupling portion 13 mat be made providing peripheral sheets 89 respectively emerging from the top edge and the bottom edge 92*c*, 92*a* of the first portion 92. Each peripheral sheet 89 includes a first portion 89*a* and a second portion 89*b*, the latter interposed between the first portion 89*a* and the first portion 92 of the main sheet 91. Each peripheral sheet also includes passing-through notches 89*c*, 89*d* suitable for delimiting, at least in part, the first and second portions 89*a*, 89*b* of the peripheral sheet 89.

The container 1 may be made by folding and gluing steps of a single blank obtained by one or more die-cutting steps of a single flat sheet or by a laser cutting process of the auxiliary blank 90. The passing-through notches 40 may also be made by a die-cutting or laser cutting process, e.g., performed simultaneously with the die-cutting or laser cutting step of the auxiliary blank 90.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both, unless the this application states otherwise. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A child-proof container comprising:

a storage made of sheet material defining a compartment and having at least one side wall defining a passage opening delimited by a free edge, said passage opening being configured for placing the compartment in communication with the external environment, a closure system made of sheet material engageable to the storage for obstructing the passage opening, wherein the closure system and storage are movable with respect to each other at least between:

a closed condition where the closure system prevents communication between the compartment of the storage and the external environment, and an open condition where the closure system allows communication between the compartment of the storage and the external environment, at least a first coupling portion carried by the closure system, and at least a second coupling portion carried by the storage and configured for cooperating with said first coupling portion, wherein the first and second coupling portions are configured for engaging with each other in the closed condition to define a locking condition of the container wherein said first and second coupling portions prevent the closure system and the storage from switching from the closed to the open condition, wherein at least one of the storage and the closure system includes a release portion configured for allowing, at least in the locking condition, disengagement between the first and second coupling portions and allowing the storage and the closure system to switch from the closed to the open condition, wherein at least one of the storage and the closure system includes at least a first constraining portion and a second constraining portion overlapping to define an overlap zone which has a peripheral zone surrounding a central zone, wherein the first and second constraining portions are engaged to each other for at least part of the peripheral zone, wherein the second constraining portion delimits at least part of an outer surface of the container and, for at least part of the peripheral zone, has at least a plurality of notches suitable for defining at least one breaking portion, separable from said second constraining portion, wherein the plurality of notches comprises at least one series of the notches aligned along at least one trajectory, and wherein the series of the notches defines on the second constraining portion a plurality of breaking portions arranged at least along a section of the peripheral zone of the overlap zone.

2. The container according to claim 1, wherein the plurality of notches defines a plurality of breaking portions arranged at least along a section of the peripheral zone of the overlap zone.

3. The container according to claim 1, wherein the second constraining portion is delimited by a perimeter edge, wherein at least part of the plurality of notches extends from the perimeter edge towards the central zone.

4. The container according to claim 3, wherein at least one part of the notches of the plurality of notches has a shape having concavity facing the perimeter edge of the second constraining portion.

5. The container according to claim 1, wherein at least one notch of the plurality of notches have a shape that substantially resembles a U-shape, a C-shape or an L-shape.

6. The container according to claim 1, wherein the plurality of notches is defined over at least 50% of the extension of the peripheral zone of the overlap zone.

7. The container according to claim 1, wherein the plurality of notches comprises:

at least one auxiliary notch arranged to the side of the series of notches, in interposition between said series of notches and the central zone of the overlap zone.

8. The container according to claim 1, wherein at least part of the plurality of notches of the series of notches extends for at least a section, starting from the perimeter edge towards of the central zone.

9. The container according to claim 1, wherein the series of notches is defined over at least 70% of the extension of the peripheral zone of the overlap zone.

10. The container according to claim 1, wherein the notches of the series of notches are discrete elements, spaced apart from each other.

11. The container according to claim 10, wherein the notches of the series of notches are evenly distributed over the peripheral zone of the overlap zone.

12. The container according to claim 1, wherein the at least one auxiliary notch extends to the side of the series of notches throughout an extension of said series of notches along the peripheral zone.

13. The container according to claim 1, wherein the first and second constraining portions are engaged by means of at least one of:

one or more glued portions, one or more portions of adhesive material, or arranged at the peripheral zone overlapping the plurality of notches.

14. The container according to claim 13, wherein the glue portion and/or the adhesive material portion is arranged at the peripheral zone affected by the plurality of notches and at least partially at the central zone.

15. The container according to claim 1, wherein each notch of said plurality is solely defined on the peripheral zone of the overlap zone of the closure system.

16. The container according to claim 1, wherein the central zone of the overlap zone of the closure system is devoid of notches.

17. The container according to claim 1, wherein the number of notches of said plurality of notches is in a range of 3 to 30.

18. The container according to claim 1, wherein the ratio between a surface footprint area of the peripheral zone of the overlap zone and a surface footprint area of the central zone of the overlap zone is in a range of 0.1 to 0.25.

19. A child-proof container comprising:

a storage formed of sheet material defining a compartment and having at least one side wall defining a passage opening delimited by a free edge of the sheet material, said passage opening configured to place the compartment in communication with an external environment, a closure system formed of sheet material and engageable with the storage to obstruct the passage opening, wherein the closure system moves related to the storage between:

a closed condition where the closure system prevents communication between the compartment of the storage and the external environment, and an open condition where the closure system allows communication between the compartment of the storage and the external environment, at least a first coupling portion carried by the closure system, at least a second coupling portion carried by the storage and configured for cooperating with said first coupling portion, wherein the first coupling portion and the second coupling portion are configured to engage each other in the closed condition to define a locking condition of the container, wherein the first coupling portion and the second coupling portion prevent the closure system and the storage from switching from the closed condition to the open condition, wherein at least one of the storage system and the closure system includes a release portion configured to allow, at least in the locking condition, disengagement between the first coupling portion and the second coupling portion and to allow the storage and the closure system to switch from the closed condition to the open condition, wherein at least one of the storage system and the closure system includes at least a first constraining portion and a second constraining portion overlapping the first constraining portion to define an overlap zone;

wherein the overlap zone includes a peripheral zone and a central zone surrounded by the peripheral zone, wherein the first conditioning portion is engaged with the second constraining portion in at least part of the peripheral zone, wherein the second constraining portion delimits at least part of an outer surface of the container and, for at least part of the peripheral zone, has at least a plurality of notches configured to define at least one breaking portion, wherein the breaking portion is separable from the second constraining portion, wherein the plurality of notches comprises:

at least one series of notches comprising a plurality of notches aligned along at least one trajectory, and at least one auxiliary notch arranged to the side of the series of notches, in interposition between said series of notches and the central zone of the overlap zone, and wherein the at least one auxiliary notch extends to the side of the series of notches throughout an extension of said series of notches along the peripheral zone.

20. A child-proof container comprising:

a storage formed of sheet material that defines a compartment having at least one side wall defining a passage opening delimited by a free edge of the sheet material, said passage opening is configured to place the compartment in communication with an external environment to the child-proof container, a closure system formed of sheet material and, when engaged with the storage, obstructs the passage opening, wherein the closure system moves relative to the storage between:

a closed condition where the closure system prevents communication between the compartment of the storage and the external environment, and an open condition where the closure system allows communication between the compartment of the storage and the external environment, at least a first coupling portion carried by the closure system, at least a second coupling portion carried by the storage and cooperating with said first coupling portion, wherein the first coupling portion engages the second coupling portion, while the child-proof container is in the closed condition, to define a locking condition of the child-proof container;

wherein said first coupling portion and the second coupling portion prevent the closure system and the storage from switching from the closed condition to the open condition, wherein at least one of the storage and the closure system includes a release portion configured to allow, at least in the locking condition, disengagement between the first coupling portion and the second coupling portion to allow the storage and the closure system to switch from the closed position to the open condition, wherein at least one of the storage and the closure system includes at least a first constraining portion and a second constraining portion overlapping the first constraining portion to define an overlap zone;

wherein the overlap zone includes a peripheral zone and a central zone surrounded by the peripheral zone, wherein the first constraining portion engages the second constraining portion for at least part of the peripheral zone, wherein the second constraining portion delimits at least part of an outer surface of the container and, at least part of the peripheral zone, wherein the second constraining portion has a plurality of notches defining at least one breaking portion, wherein the breaking portion is separable from the second constraining portion, wherein the first constraining portion and the second constraining portion are engaged by at least one of:

one or more glued portions, one or more portions of adhesive material, or arranged at the peripheral zone overlapping the plurality of notches, and wherein the glue portion and/or the adhesive material portion is arranged at the peripheral zone affected by the plurality of notches and at least partially at the central zone.

* * * * *